US006799541B1

(12) United States Patent
Clinton et al.

(10) Patent No.: US 6,799,541 B1
(45) Date of Patent: Oct. 5, 2004

(54) CYLINDER SLEEVE WITH COOLANT GROOVE

(75) Inventors: David L. Clinton, Leucadia, CA (US); Gary L. Cyr, San Marcos, CA (US); Stephan J. Demirjian, Oceanside, CA (US)

(73) Assignee: Darton International, Inc., Carlsbad, CA (US)

( * ) Notice: Subject to any disclaimer, the term of this patent is extended or adjusted under 35 U.S.C. 154(b) by 0 days.

(21) Appl. No.: 10/281,455

(22) Filed: Oct. 25, 2002

(51) Int. Cl.[7] ..... F02F 1/10
(52) U.S. Cl. ..... 123/41.84
(58) Field of Search ..... 123/41.74, 41.84, 123/41.79, 41.72, 193.2, 193.1, 41.83, 668, 669, 41.81

(56) References Cited

U.S. PATENT DOCUMENTS

| | | | | |
|---|---|---|---|---|
| 1,607,265 A | | 11/1926 | Leipert | |
| 1,643,645 A | | 9/1927 | Strand | |
| 1,853,562 A | | 4/1932 | Herr | |
| 2,361,434 A | | 10/1944 | Surtees | 29/156.4 |
| 2,681,054 A | | 6/1954 | Boghossian | 123/195 |
| 2,783,749 A | | 3/1957 | Effmann | 123/41.83 |
| 2,974,654 A | | 3/1961 | Bouvy | 123/55 |
| 3,315,573 A | | 4/1967 | De Coye de Castelet | 92/171 |
| 3,389,693 A | | 6/1968 | Herschmann et al. | 123/41.84 |
| 3,418,993 A | | 12/1968 | Schiterlein et al. | 123/195 |
| 3,439,586 A | | 4/1969 | Holtan et al. | 92/169 |
| 3,568,573 A | | 3/1971 | Bailey et al. | 92/171 |
| 3,659,569 A | * | 5/1972 | Mayer et al. | 123/41.79 |
| 3,792,518 A | | 2/1974 | Cross et al. | 29/156.4 |
| 3,828,415 A | | 8/1974 | Kammeraad et al. | 29/401 |
| 3,828,756 A | | 8/1974 | Kammeraad et al. | 123/188 |
| 4,093,842 A | | 6/1978 | Scott | 219/121 |
| 4,447,275 A | | 5/1984 | Hiraoka et al. | 148/152 |
| 4,495,907 A | | 1/1985 | Kamo | 123/193 |
| 4,562,799 A | | 1/1986 | Woods et al. | 123/193 |
| 4,601,265 A | * | 7/1986 | Wells et al. | 123/41.28 |
| 4,796,572 A | | 1/1989 | Heydrich | 123/41.42 |
| 5,086,733 A | * | 2/1992 | Inoue et al. | 123/41.84 |
| 5,251,579 A | | 10/1993 | Morris | 123/41.84 |
| 5,450,827 A | | 9/1995 | Kang | 123/193.2 |
| 5,497,693 A | | 3/1996 | Ward | 92/169.1 |
| 6,167,847 B1 | | 1/2001 | Ergezen et al. | 123/41.79 |
| 6,196,195 B1 | | 3/2001 | Trutschel et al. | 123/470 |
| 6,318,330 B1 | | 11/2001 | Kestner et al. | 123/193.2 |
| 6,412,172 B1 | | 7/2002 | Kestner et al. | 29/888.061 |
| 6,439,173 B1 | | 8/2002 | Chung | 123/41.84 |

FOREIGN PATENT DOCUMENTS

| | | | | |
|---|---|---|---|---|
| FR | 588551 A | * | 11/1924 | |
| JP | 58-220944 | | 12/1983 | |
| JP | 60-239485 | | 5/1987 | |
| JP | 06-330806 | | 11/1994 | |
| JP | 10159645 A | * | 6/1998 | F02F/1/16 |

OTHER PUBLICATIONS

Patent Abstract for Japanese Publication No. 06–330806, published Nov. 29, 1994.
Patent Abstract for Japanese Publication No. 58–220944, published Jun. 15, 1982.
Patent Abstract for Japanese Publication No. 62–099660, published May 09, 1987.

* cited by examiner

*Primary Examiner*—Tony M. Argenbright
*Assistant Examiner*—Hyder Ali
(74) *Attorney, Agent, or Firm*—Heller Ehrman White & McAuliffe

(57) ABSTRACT

A cylinder sleeve for an internal combustion engine having an engine block and a cylinder head. The cylinder sleeve includes a cylindrical section having a top portion and a bottom portion, and configured to receive a cylinder piston that reciprocates in the block. The top portion is configured to mate with the cylinder head. The cylinder sleeve also includes a flange section adjacent to the top portion of the cylindrical section. The flange section is configured with a coolant groove and at least one coolant hole to provide a passageway for coolant to pass into the coolant groove of the flange section.

45 Claims, 25 Drawing Sheets

CYLINDER SLEEVE WITH COOLANT GROOVE

BACKGROUND

This invention relates generally to internal combustion engines and, more particularly, to cylinder sleeves that provide bores that receive the pistons of such engines.

An internal combustion engine generates a great amount of heat as a result of the combustion processes taking place in the engine block. Pistons move within cylinder bores toward and away from a cylinder head that includes intake and exhaust valves. The cylinder head seals the top end of a cylinder bore. The cylinder bores, head, and pistons form combustion chambers of the engine. As a piston travels upwardly toward the top of the cylinder bore, a gas/fuel mixture is compressed within the cylinder. The cylinder pressure can be as high as 10,000 psi. Prior to reaching the top of the piston travel, a spark and the compression of the mixture causes a controlled burn that can reach as high as 1400° C. The controlled burning of the compressed gas/fuel mixture pushes the piston downward in the cylinder, thereby rotating a crankshaft. The burning of the gas/fuel mixture generates a significant amount of heat within the engine.

The operating temperature of an engine can generally be maintained within acceptable limits by the circulation of coolant in the engine block, around the cylinders, and through portions of the cylinder head. Demands for greater horsepower output of engines, and for reduced hydrocarbon emissions in conjunction with catalyst systems, have both resulted in substantially increased combustion temperatures and hotter running engines. The increased temperatures occur primarily within the engine block, especially near the most highly heated top portions of the cylinders, near the cylinder head.

Some engines utilize cylinder sleeves that are inserted within the cylinder bores of an engine block. Alternatively, the block can be cast around the cylinder sleeves. If the sleeves come in contact with engine coolant, then the sleeves are referred to as wet sleeves. In other configurations, the cylinder sleeves might be located totally within an existing cylinder bore of the engine, such that coolant does not come into contact with the cylinder sleeve. These sleeves are referred to as dry sleeves. Unfortunately, without coolant contact, the most highly heated portion of the cylinder sleeve might not be adequately cooled. Some aftermarket applications provide a cylinder sleeve that is inserted within an existing cylinder bore of an engine block, to strengthen the engine and improve performance. Cylinder sleeves are typically made of high-strength metal compositions for increased performance.

Other configurations of cylinder sleeves can improve cooling flow. For example, some cylinder sleeves are provided with an upper collar or flange. The flange includes holes configured as vertical passageways that permit coolant to pass through the flange and into the cylinder head. This improves cooling of the selected upper flange area of the cylinder sleeve, but heat can still build up along the uppermost portion of the sleeve and in the hottest portions of high performance engines.

FIG. 1 illustrates a partial cross-sectional view of a conventional internal combustion engine 100 that includes an engine block 106, a cylinder sleeve 102, a cylinder head 130, and a piston 110. The cylinder sleeve 102 includes a flange portion 108. The sleeve is slidably inserted into a cylinder bore 104 within the engine block 106 until a support shoulder 112 of the cylinder sleeve comes in contact with a ledge 114 of the engine block 106. The ledge positions the top surface 120 of the cylinder sleeve 102 to be substantially flush with the cylinder head seating surface 122 formed by the engine block 106 and top of the flange 108. Those skilled in the art will appreciate that a gasket (not illustrated) can be positioned between the lower surface of the cylinder head 130 and the cylinder head seating surface 122 to provide improved combustion chamber sealing.

The inner wall 126 of the cylinder sleeve 102, the lower surface of the cylinder head 130, and the top surface of the piston 110 form a combustion chamber 124. On the piston intake stroke, the piston 110 moves downwardly, away from the cylinder head, and a mixture of air and vaporized fuel is drawn into the combustion chamber 124 through an intake valve port 132. Approximately when the piston 110 reaches the lower limit of the piston travel area 116, an intake valve is closed, shutting off the intake port 132 and sealing off the combustion chamber 124. The piston then begins upward movement, toward the cylinder head. As the piston moves upwardly, the air/fuel mixture is compressed as the combustion chamber 124 is reduced in volume. The compression of the air/fuel mixture increases the pressure in the combustion chamber 124, and also increases the mixture temperature. Approximately as the piston 110 reaches the top position of its travel (as shown in FIG. 1, also referred to as "top dead center"), the air/fuel mixture is ignited with a controlled bum. The ignition creates an exhaust in the combustion chamber that presses against the piston 110 and moves the piston rod 128 down to rotate the crankshaft (not illustrated). The burned exhaust gas is forced out through the exhaust valve port 134.

For engine cooling of the FIG. 1 configuration, coolant is circulated into and out of an annular coolant gap 136 via coolant passages (not illustrated) in the block 106. The most highly heated portion of the cylinder sleeve 102 and the cylinder head 130 is the area adjacent to the combustion chamber 124 near the flange 108. It should be apparent in FIG. 1 that the most highly heated portion is not effectively cooled, because coolant in the coolant gap 136 is generally not in contact with this most highly heated portion of the sleeve 102, but rather is restricted to contact below the flange 108.

It is known to circulate coolant within an annular gap 140 located within the flange 108. Coolant passages (not illustrated) permit coolant to circulate into and out of the annular gap 140. This improves cooling of the sleeve flange, but more thorough cooling of the sleeve with greater control of the cooling is desirable.

From the discussion above, it should be apparent that there is a need for more efficient and controlled cooling of the most highly heated portions of internal combustion engines. The present invention solves this need.

SUMMARY

The present invention overcomes the above-described shortcomings by providing a cylinder sleeve for an internal combustion engine having an engine block and a cylinder head, wherein the cylinder sleeve includes a cylindrical section having a top portion and a bottom portion, and a flange section adjacent to the top portion, such that the flange section is configured to include a coolant groove and at least one coolant hole that provides a passageway for coolant to pass through the flange and into the coolant groove. The coolant groove provides improved cooling of the flange and the upper portion of the cylinder sleeve. In this way, the cylinder sleeve provides more efficient and controlled cooling of the most highly heated portions of internal combustion engines.

In one aspect, an internal combustion engine can be provided with cylinder sleeves so that the engine includes an engine block having at least one bore, a cylinder head including at least one coolant port, and at least one cylinder sleeve that corresponds to the cylinder bore of the block. Each of the cylinder sleeves includes a cylindrical inner surface having a longitudinally extending axis, an outer surface, and at least one coolant passageway. The outer surface of the sleeve has a lower mating region that is adapted to be at least partially fitted into a cylinder bore of an engine block of the internal combustion engine. The outer surface is in communication with a flow of coolant. The flow of coolant can pass from the outer surface of the sleeve into coolant ports, through the sleeve flange, and into a cylinder head of the internal combustion engine. The coolant passageway includes a groove that provides lateral flow of coolant through the flange and into the cylinder head.

In another aspect, a method for cooling highly heated portions of a cylinder sleeve and a cylinder head is described. Coolant flows into a groove configured about an upper portion of the flange section in the cylinder sleeve. Once inside the groove, the coolant is directed about the upper portion of the flange section and can be channeled into an area of the cylinder head disposed above the groove.

Other features and advantages of the present invention should be apparent from the following description of the preferred embodiments, which illustrates, by way of example, the principles of the invention.

DETAILED DESCRIPTION

In recognition of the above-stated shortcomings associated with conventional designs of internal combustion engines, this disclosure describes exemplary embodiments for a cylinder sleeve having a flange section configured with a coolant groove and at least one coolant hole to provide a passageway for coolant to pass through the flange to the groove and to flow laterally along the groove in the upper surface of the flange. If desired, the coolant can flow into an area of the cylinder head, above the cylinder sleeve flange. Different sizes and positions of the coolant holes may be configured to route the coolant to more highly heated portions of the cylinder sleeve. Consequently, for purposes of illustration and not for purposes of limitation, the exemplary embodiments of the invention are described in a manner consistent with such use, though the invention is not so limited.

Figure 1:
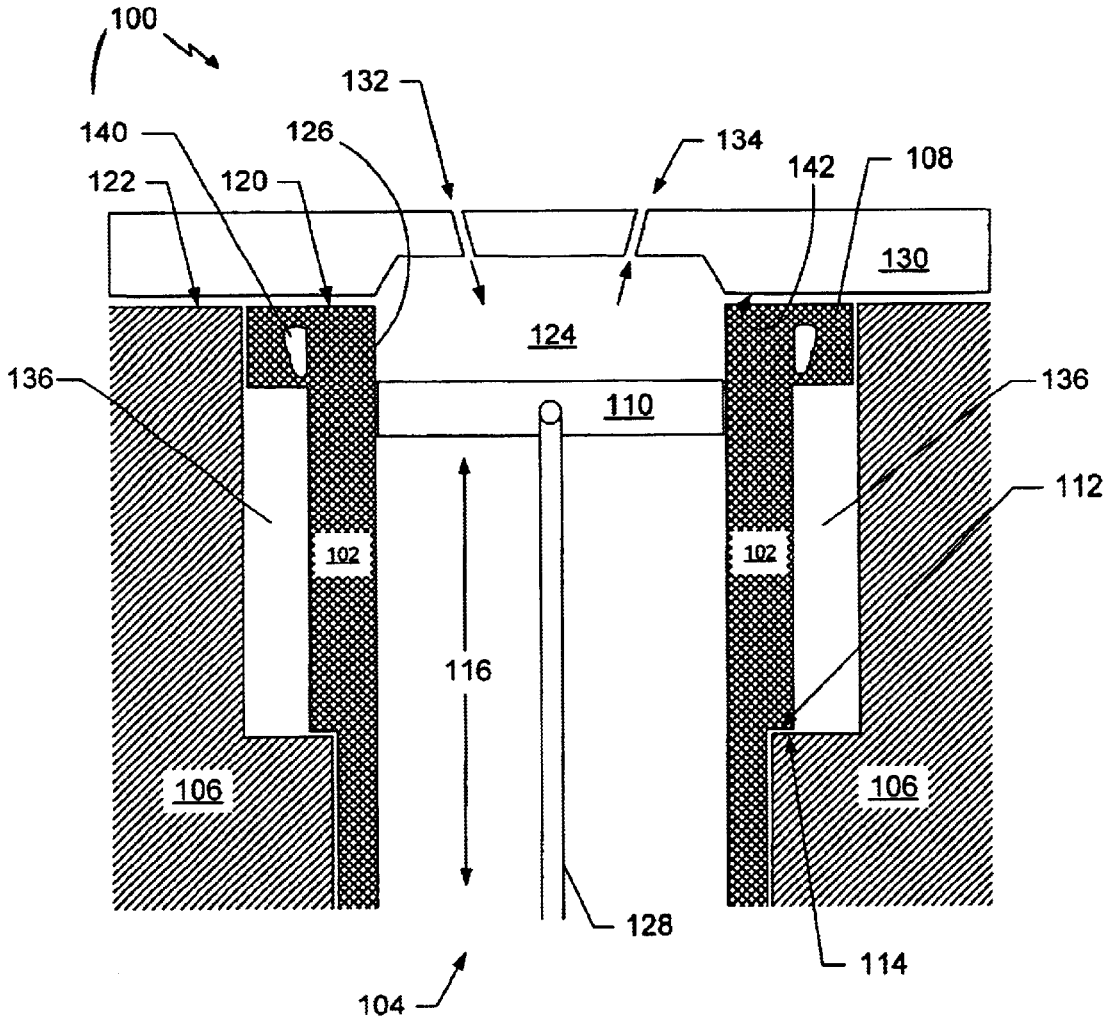
FIG. 1 (PRIOR ART)
FIG. 1 illustrates a partial cross-sectional view of a conventional internal combustion engine.
Figure 2:
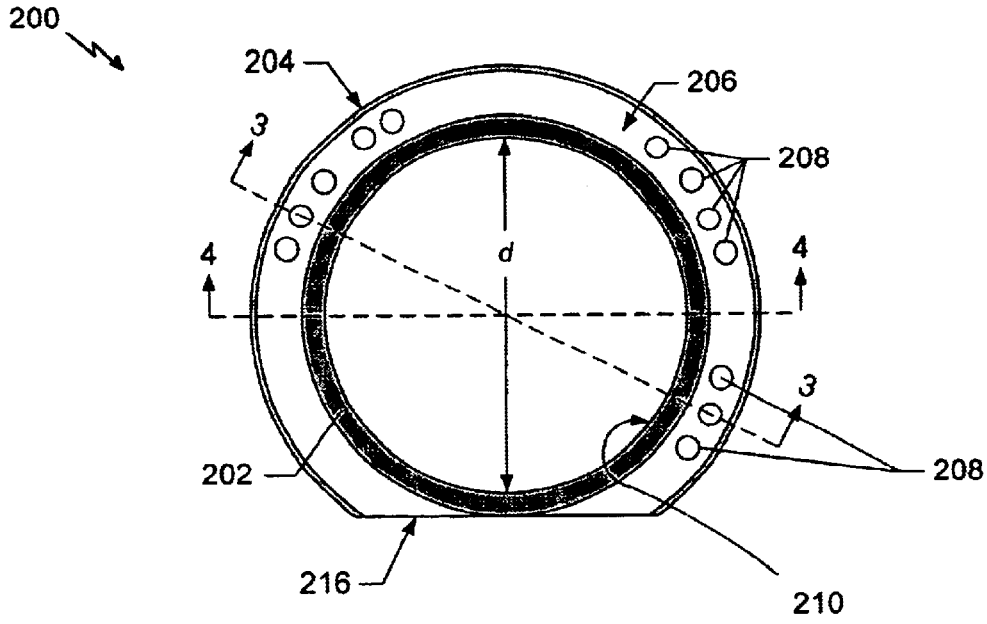
FIG. 2 is a top view of a cylinder sleeve in accordance with an exemplary embodiment of the invention.
Figure 3:
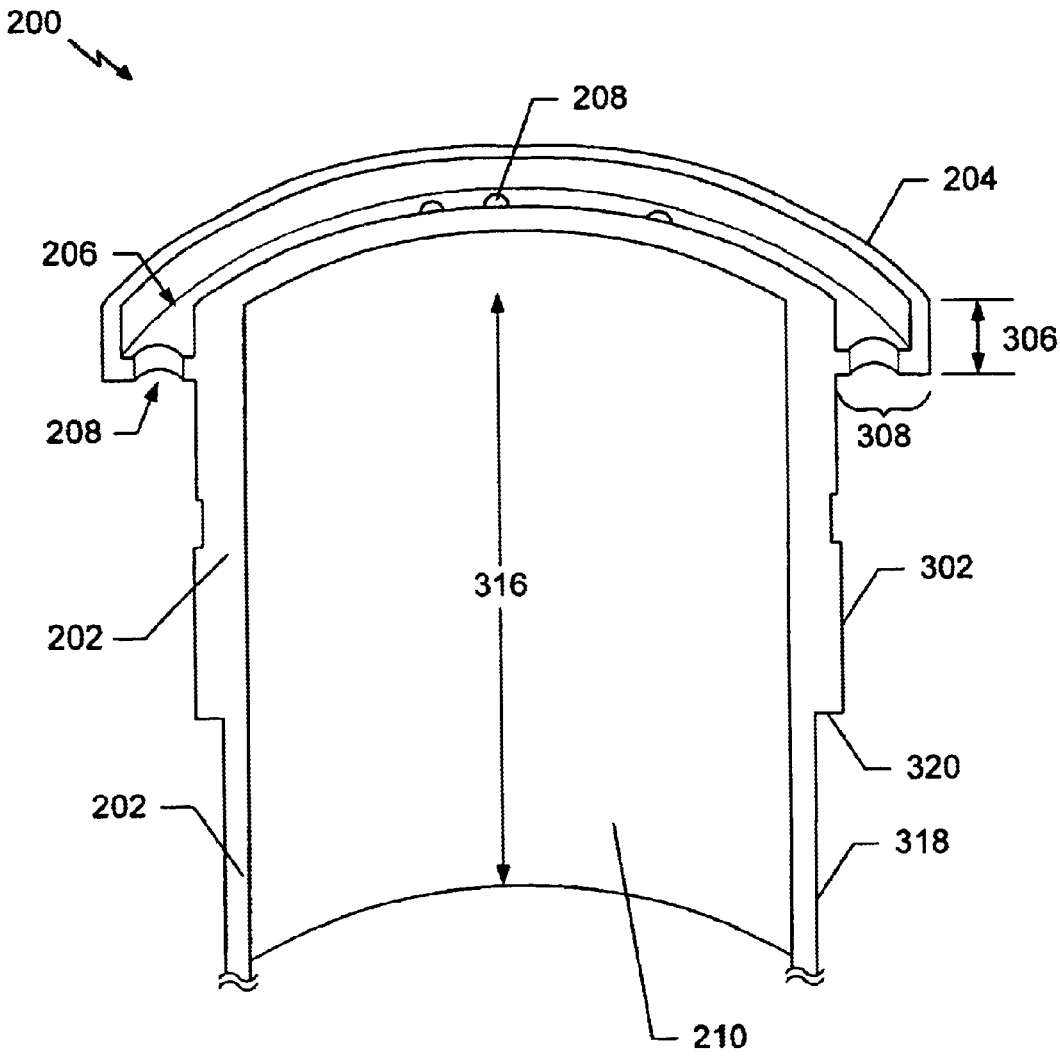
FIG. 3 is a partial cross-sectional perspective view of an exemplary cylinder sleeve taken along the line 3-3 of FIG. 2.
Figure 4:
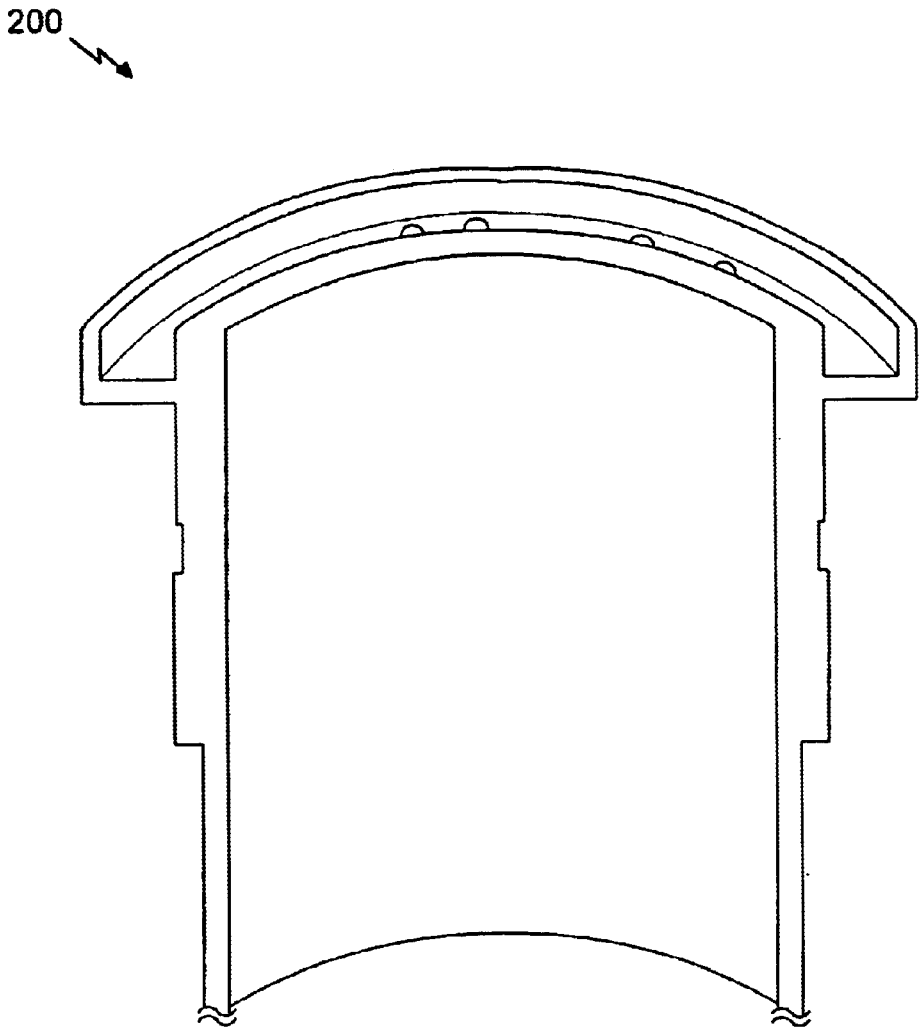
FIG. 4 is a partial cross-sectional perspective view of an exemplary cylinder sleeve taken along the line 4-4 of FIG. 2.

A top view of an exemplary cylinder sleeve 200 is illustrated in FIG. 2; FIG. 3 is a partial cross-sectional perspective view of the exemplary cylinder sleeve 200 taken along the line 3-3 of FIG. 2; and FIG. 4 is a partial cross-sectional perspective view taken along the line 4-4 of FIG. 2. The cylinder sleeve 200 includes a cylindrical section 202 and a flange section 204. The cylindrical section 202 includes a radial inner surface 210 of substantially uniform diameter (d) within which is received a reciprocating piston. However, the radial inner surface 210 may have a non-uniform diameter so that the cylindrical section 202 may receive a reciprocating piston of any shape. The flange section 204 is radially coupled to the top portion of the cylindrical section 202. The cylindrical section 202 and the flange section 204 are typically cast or machined into a single sleeve 200 to provide strength and rigidity. An exemplary cylinder sleeve 200 shown in FIG. 2 can be manufactured with centrifugal ductile iron that yields a tensile strength of approximately 130,000 lbs. However, in some embodiments, the sections 202 and 204 can be manufactured separately and coupled together by welding or by other means of attachment.

The flange section 204 includes a groove 206 in its upper surface, and at least one coolant hole 208. FIG. 2 shows twelve coolant holes 208 spaced around the groove 206, but other numbers of coolant holes 208 can be provided, depending on the cooling requirements of the engine. Furthermore, distances between the holes 208 can also be varied according to the cooling requirements. For example, the size, number, and location of the holes can be varied according to what is needed to adequately cool the hottest areas of the combustion chamber. The coolant holes 208 provide a passageway for coolant to flow from the outer surface of the cylinder sleeve 200 into the groove 206, which enables the flow of coolant to extend laterally through at least a portion of the groove 206. The coolant can then flow into coolant ports in an area of a cylinder head that is configured above the cylinder sleeve 200 and, in particular, in an area that is disposed above the groove 206. In the exemplary embodiment, the groove 206 is formed as a recess within the flange section 204 that provides a passageway for coolant to flow laterally and thereby extend the cooling effect of the coolant around the flange section 204. In this embodiment, the open groove 206 allows the coolant to cool the cylinder head area that is disposed above the groove 206.

FIG. 3 is a partial cross-sectional perspective view of the exemplary cylinder sleeve 200 taken along the line 3-3 of FIG. 2, which bisects the cylinder sleeve 200 through two coolant holes 208. The exemplary embodiment shows the cylinder sleeve 200 including a cylindrical inner surface 210, an outer surface 302, and the coolant holes 208 in the groove 206. In the illustrated embodiment, the cylindrical inner surface 210 extends longitudinally along a longitudinal axis 316. The outer surface 302 of the sleeve 200 includes a lower mating region 318 that is adapted to be at least partially fitted into a cylinder bore of an engine block (see FIG. 8). A shoulder 320 formed on the outer surface 302 allows the cylinder sleeve 200 to rest on a ledge (e.g., 808 in FIG. 8 and FIG. 9) formed in the cylinder bore. The outer surface 302 also includes the upper flange section 204 having a predetermined width 306 and a predetermined depth 308. The coolant groove 206 and holes 208 allow the flow of coolant to pass from the outer surface 302 through the passageways 206, 208 and into the cylinder head of the engine. In one embodiment, the coolant passageways 206, 208 may be included within the upper flange section 204.

The width 306 and depth 308 of the groove 206 can be adjusted to restrict or allow the flow of coolant through the coolant holes 208 into the groove 206, to extend laterally through the groove, and to flow into the cylinder head according to the cooling needs of the engine. The positioning/grouping and the number of the coolant holes 208 can also be varied according to the location of hot spots in the cylinder sleeve 200 and the cylinder head. For example, a greater number of coolant holes can be located in the vicinity of the cylinder exhaust valves, where temperatures are higher. Furthermore, the groove 206 and the coolant holes 208 may be used to control the velocity of the coolant flow and to achieve a desired temperature distribution through the cylinder sleeve 200 and the cylinder head. For example, the coolant flow can be adjusted such that the velocity is not so high that the coolant does not properly absorb heat and efficiently cool combustion, and such that the velocity is not so low that the coolant is turned into steam.

FIG. 4 is a partial cross-sectional perspective view of the exemplary cylinder sleeve 200 taken along the line 4-4 of FIG. 2, which is slightly offset in angle from the line 3-3, and does not pass through the coolant holes 208.

Figure 5:
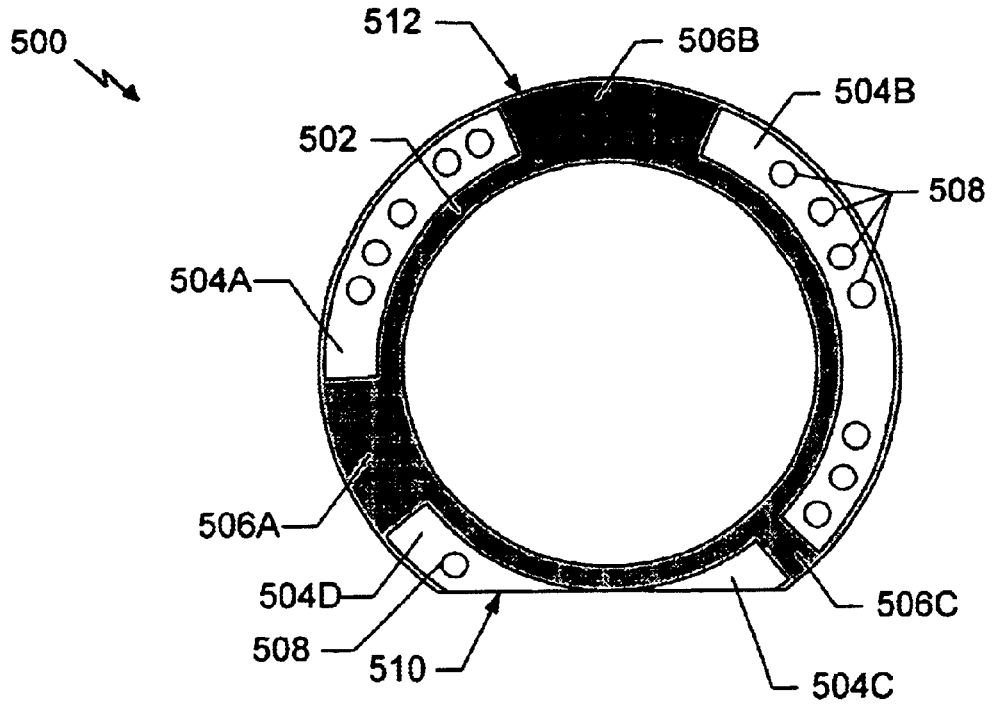
FIG. 5 is a top view of a cylinder sleeve in accordance with an alternative embodiment of the invention.

FIG. 2, FIG. 3, and FIG. 4 show a groove 206 that circumferentially extends completely around the periphery of the flange section 204. In an alternative embodiment shown in FIG. 5, the coolant groove in the cylinder sleeve 500 provides lateral flow of coolant and is configured as a plurality of partial grooves or coolant recesses 504A, 504B, 504C, 504D (referred to collectively as the grooves 504). The FIG. 5 configuration allows lateral flow of coolant through certain regions of the sleeve flange and the cylinder head. However, as can be seen in FIG. 5, the partial grooves 504 may also restrict the lateral flow between these regions so coolant does not flow completely around the periphery of the flange section 512, to more precisely control the extent and velocity of the coolant flow. Hence, in the FIG. 5 configuration, the coolant recesses do not provide a groove that completely extends circumferentially around the cylindrical section 502 but rather includes partial grooves 504A, 504B, 504C, 504D interspersed with solid radial flange regions 506.

Figure 11:
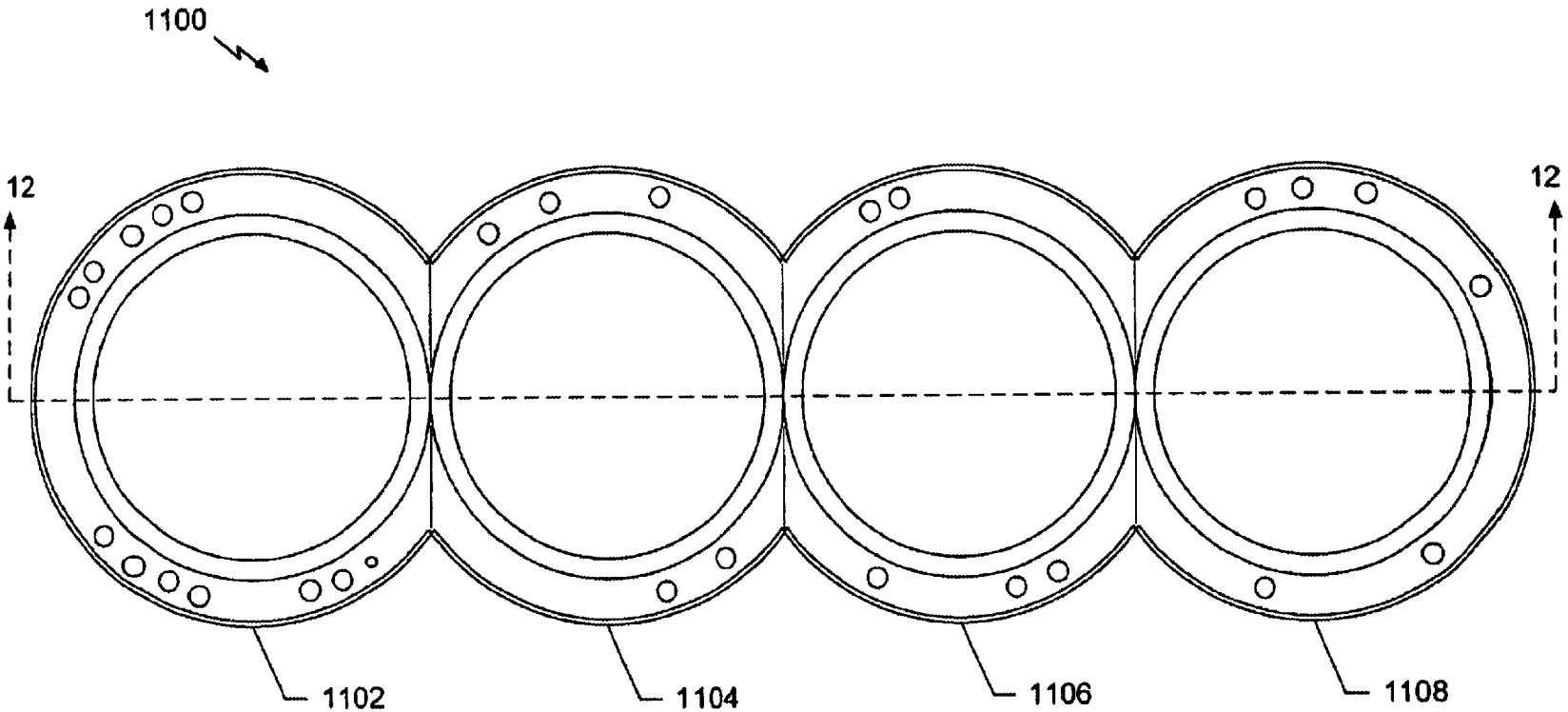
FIG. 11 is a top view of a plurality of cylinder sleeves configured within the engine block in accordance with an embodiment of the invention.

The exemplary cylinder sleeves 200 of FIG. 2 and 500 of FIG. 5 have a section 216, 510, respectively, of the groove 206 or the partial grooves 504 finished with flat surfaces to enable two or more of the respective sleeves 200, 500 to be fit together in an adjacent coupled configuration. Thus, the coupling of the sleeves may allow or restrict the flow of coolant between the grooves 206, 504 in the coupled cylinder sleeves 200, 500. Since the exemplary cylinder sleeves 200, 500 have only one flat section 216, 510, respectively, the sleeves 200, 500 as shown may be used as an end cylinder sleeve in a "siamesed" cylinder sleeve configuration (see FIG. 11). It should be apparent that a sleeve with two opposed flat sections 216, 510 can be used with two other sleeves on each side, as depicted in FIG. 11.

It can been seen that typically each partial groove 504 in FIG. 5 includes at least one coolant hole 508. However, a partial groove 504C that is bordered by a flat section 510 may be configured with no coolant holes, because a cylinder sleeve that is fitted adjacent to the straight section 510 of the sleeve 500 may have a groove or partial groove (coolant recess) on the other side of the partial groove 504C, such that coolant can flow into the partial groove. That is, when the two cylinder sleeves are coupled together, the partial groove 504C can be in flow communication with a matching groove or partial groove in an adjacent cylinder sleeve. This is illustrated further in the drawings described below.

Figure 6:
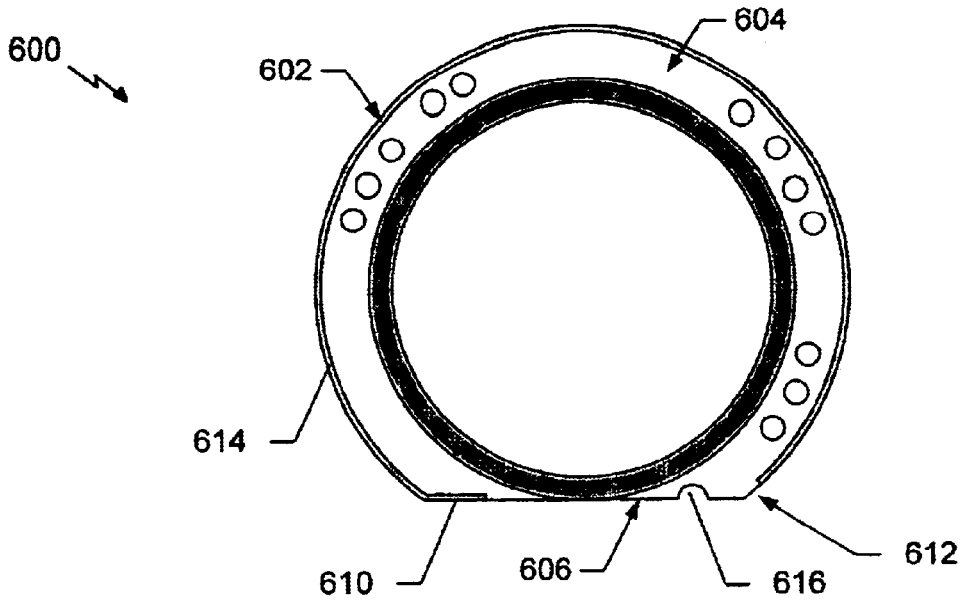
FIG. 6 is a top view of a cylinder sleeve in accordance with another alternative embodiment of the invention.
Figure 7:
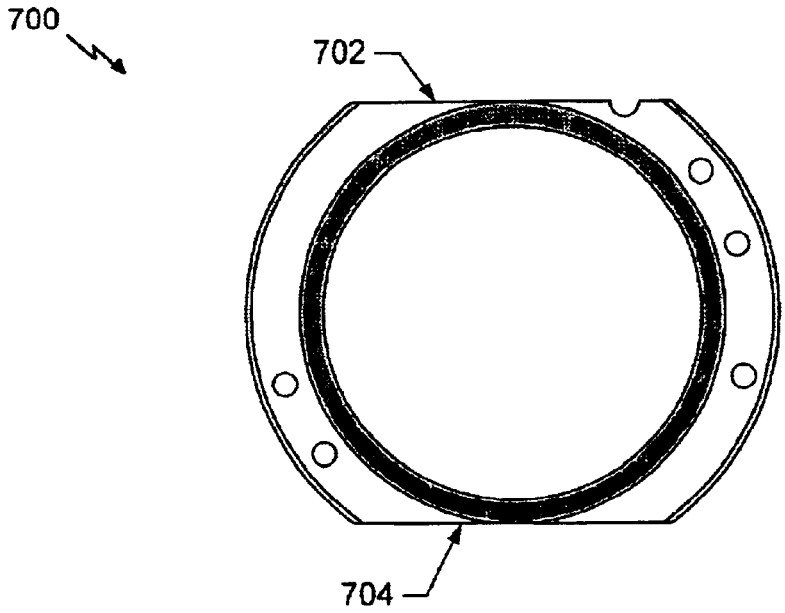
FIG. 7 is a top view of a cylinder sleeve in accordance with another alternative embodiment of the invention.

Other variations and alternatives of the sleeve design are contemplated and are depicted in alternative embodiments of FIG. 6 and FIG. 7. For example, in the alternative embodiment 600 illustrated in FIG. 6, a partial hole 616 is provided at the edge of the flat section 606 of the cylinder sleeve 600. The partial hole 616 is configured to couple with a matching partial hole in another sleeve, such as the sleeve 700 illustrated in FIG. 7. The sleeves 600, 700 are configured so they can be positioned with the flat surface 606 adjacent to the complementary flat surface 702. This configuration may be used to adjust the flow of coolant through the grooves of the coupled cylinder sleeves.

In another aspect, the flat section 606 of FIG. 6 may also include an extended wall 610 that continues the outer wall 614 of the flange section 602 formed by a recess in the groove 604. The length of the extended wall 610 can be adjusted to control the flow of coolant within and between the grooves of the coupled cylinder sleeves. In another aspect of the alternative embodiment shown in FIG. 6, the outer wall 614 of the flange section 602 can be cut short, or configured so it does not extend completely around to the flat section 606, creating an opening 612 through which coolant can flow. This opening 612 in the outer wall 614 may be used to allow the coolant to flow into the groove 604 near especially hot spot regions of the flange section 602.

In another aspect of the alternative embodiment shown in FIG. 7, the cylinder sleeve 700 is configured with two flat sections 702, 704. Thus, the section 702 may mate with the section 606 of the cylinder sleeve 600 and with a like surface on another cylinder sleeve. Accordingly, this configuration of the sleeve 700 may be used as a middle cylinder sleeve in a siamesed cylinder sleeve configuration (see FIG. 11).

Figure 8:
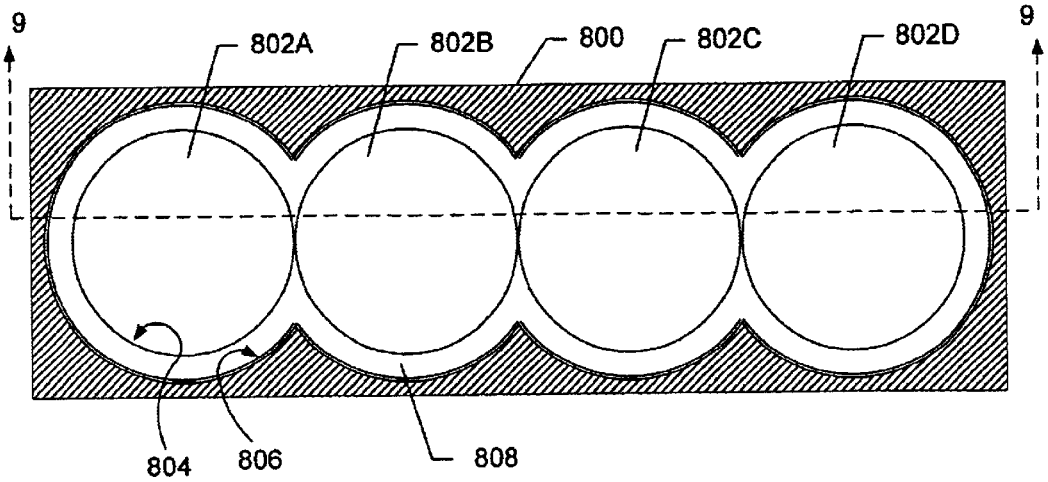
FIG. 8 is a top view of a plurality of cylinder bores within an engine block.
Figure 9:
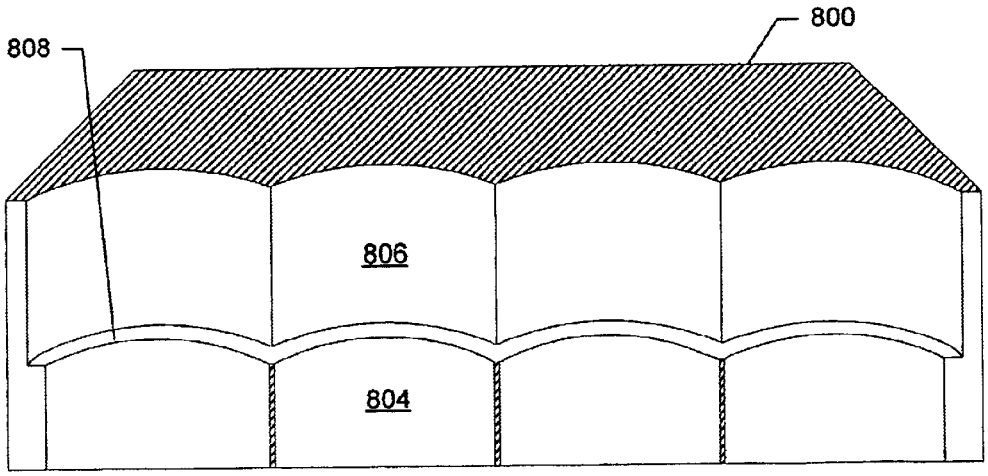
FIG. 9 is a partial cross-sectional perspective view of the cylinder bores within an engine block taken along the line 9-9 of FIG. 8.

FIG. 8 is a top view of an engine block 800 constructed in accordance with an exemplary embodiment of the invention. The engine block 800 includes a plurality of successively-aligned cylinder bores 802. FIG. 9 is a partial cross-sectional perspective view of the cylinder bores 802 within the engine block 800 taken along the line 9-9 of FIG. 8. Each cylinder bore 802 is constructed similarly and is adapted to receive a cylinder sleeve. The cylinder bore 802 includes a lower wall 804 of one diameter and an upper wall 806 of a greater diameter so as to form a ledge 808 at the juncture thereof. The ledge 808 forms a shoulder (e.g., 320 of FIG. 3) on the outer surface of the cylinder sleeve that will come in contact with and provide a secure fitting of the cylinder sleeve into the bore 802.

Figure 10:
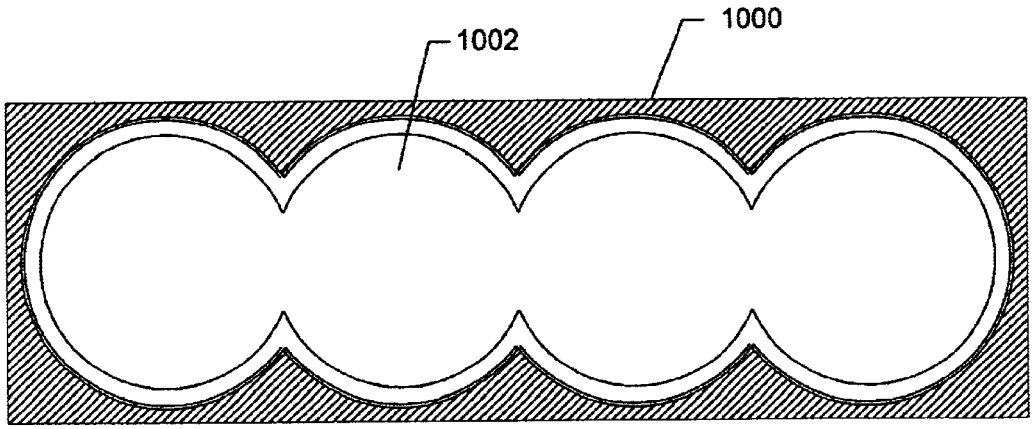
FIG. 10 is a top view of a plurality of cylinder bores within an engine block where the cylinder bores are coupled so that the bores form a single opening.

In an alternative embodiment of the engine block 1000 shown in FIG. 10, the cylinder bores are coupled so that the bores form a single cavity 1002 that is adapted to receive a series of successively-aligned siamesed cylinder sleeves.

FIG. 11 is a top view of a plurality of successively-aligned siamesed cylinder sleeves 1100 constructed in accordance with an embodiment of the invention. As described above, the siamesed cylinder sleeves 1100 are configured to be slidably inserted into a cylinder bore 802 or 1002 of an engine block 800 or 1000. In the illustrated embodiment, the plurality of siamesed cylinder sleeves 1100 includes four exemplary cylinder sleeves 1102, 1104, 1106, 1108. Each of the two end cylinder sleeves 1102, 1108 has only one flat section similar to the exemplary cylinder sleeve 200 of FIG. 2 and otherwise has a rounded flange section. Thus, these sleeves 1102, 1108 are configured as end sleeves. Each of the two cylinder sleeves 1104, 1106 has two flat sections similar to the exemplary cylinder sleeve 700 of FIG. 7. Thus, these sleeves are configured as middle sleeves. The coolant holes in the grooves of the sleeves 1102, 1104, 1106, 1108 are configured to control the flow of coolant through the grooves of all the sleeves in the siamesed configuration.

Figure 12:
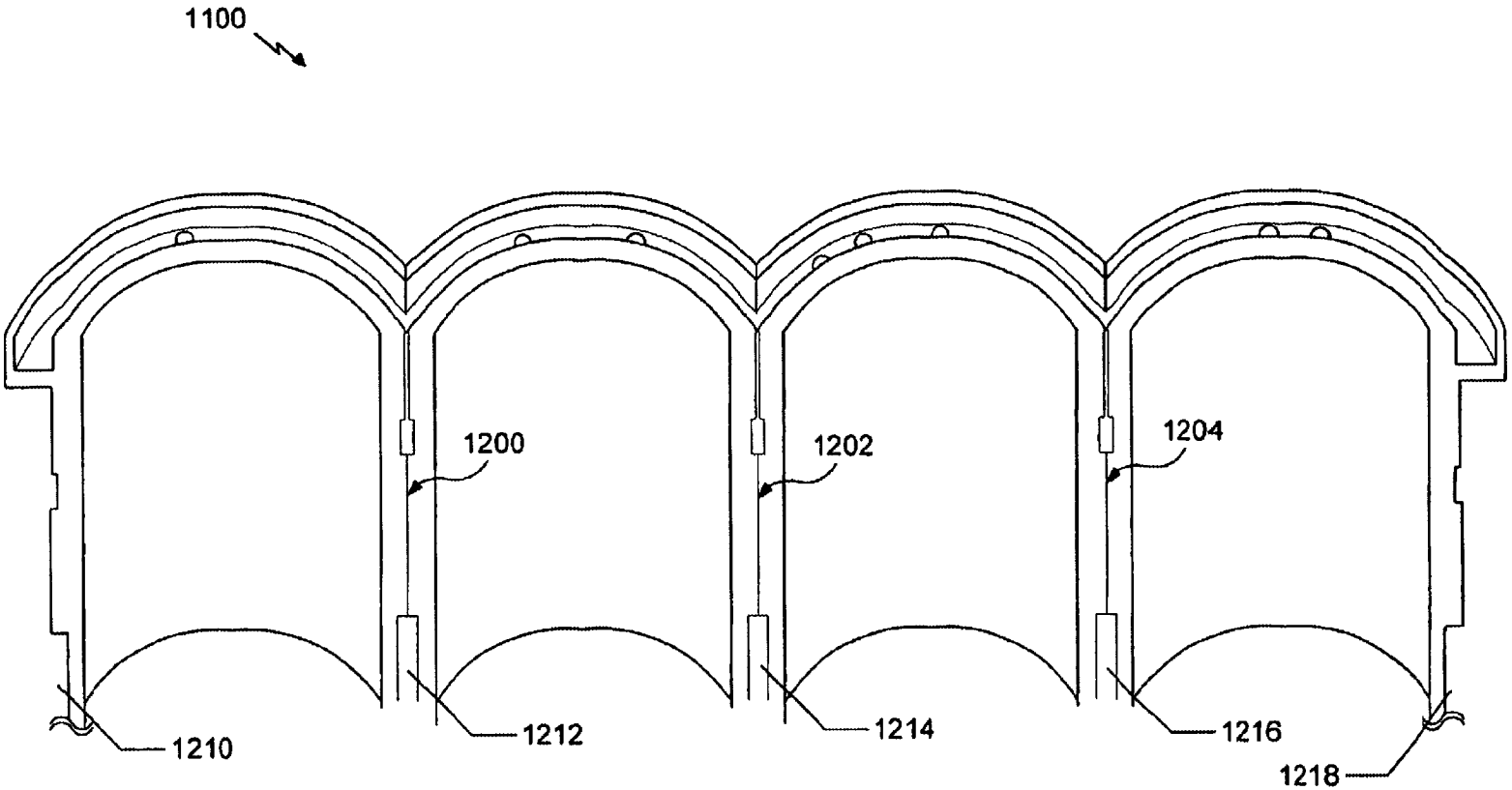
FIG. 12 is a partial cross-sectional perspective view of the plurality of successively-aligned siamesed cylinder sleeves taken along the line 12-12 of FIG. 11.

FIG. 12 is a partial cross-sectional perspective view of the plurality of successively-aligned siamesed cylinder sleeves 1100 taken along the line 12-12 of FIG. 11. This cross-sectional view of the cylinder sleeves 1100 reveals sleeve joining points 1200, 1202, 1204 and lower mating regions 1210, 1212, 1214, 1216, 1218 adapted to be inserted into the lower wall 804 (FIG. 9) of the cylinder bores.

Figure 13:
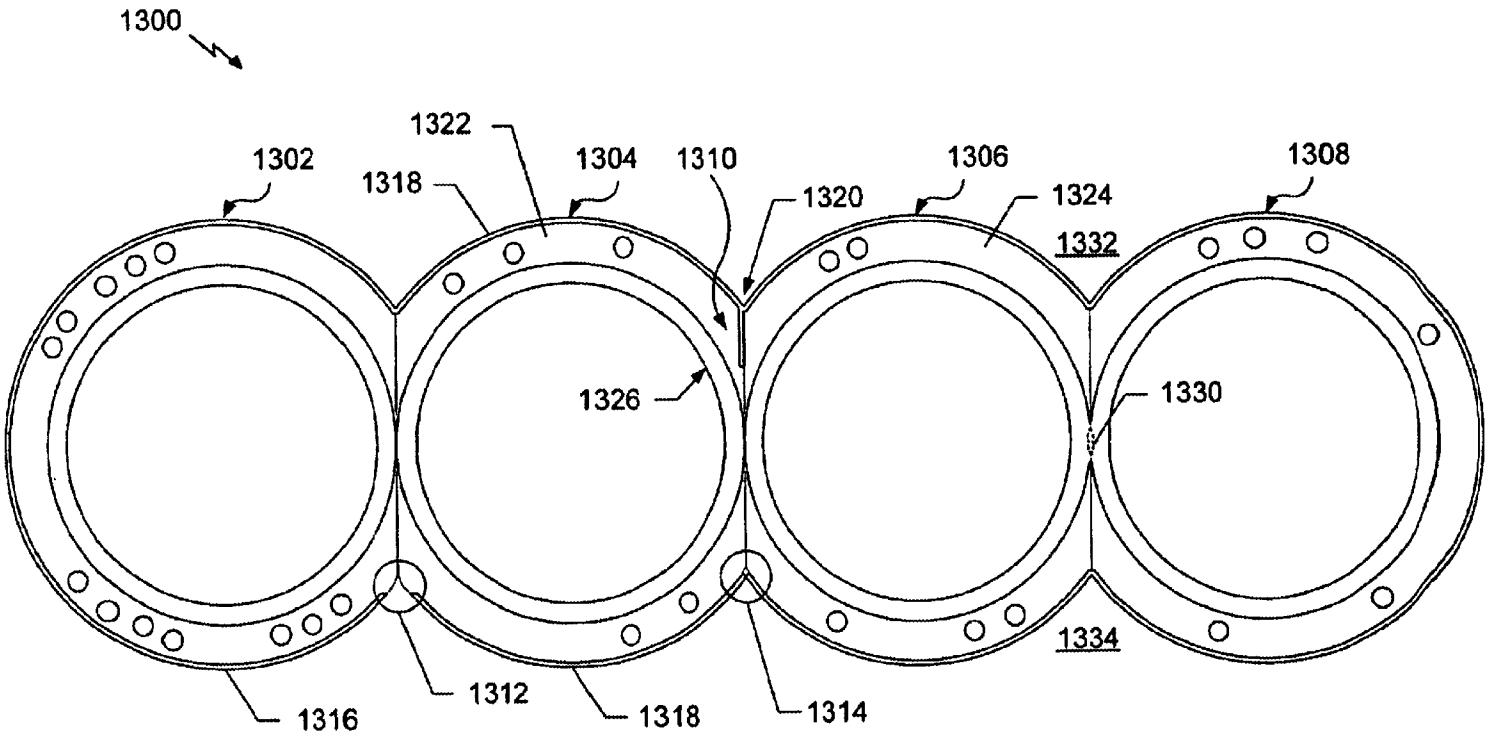
FIG. 13 is a top view of a plurality of siamesed cylinder sleeves configured within the engine block in accordance with an alternative embodiments of the invention.

Other variations and alternatives of the sleeve design are contemplated and illustrated in FIG. 13 as alternative embodiments 1300 of a plurality of siamesed cylinder sleeves 1302, 1304, 1306, 1308. For example, the sleeve 1304 includes an extension wall 1310 that extends the outer wall 1318 of the flange beyond a groove joining point 1320 of the sleeves 1304, 1306. The configuration of the extension wall 1310 controls the flow of coolant within and between the grooves 1322 and 1324 of the sleeves 1304 and 1306, respectively. This may allow the coolant to pass through an area near a hot spot 1326 at a suitable velocity to appropriately cool the hot spot 1326.

Other alternative embodiments include a gap 1312 in a groove joining point of the sleeves 1302, 1304. The gap 1312 is created by not fully extending the outer walls 1316, 1318 of the sleeves 1302, 1304, respectively. The gap 1312 may provide a passageway for the coolant to flow from the outer surface of the sleeves into the grooves of the sleeves 1302, 1304. The size of the gap 1312 can be adjusted to control the amount of coolant that flows in and out of the grooves and to control the exchange of coolant directly between the groove and the coolant in the engine block. Accordingly, a second gap 1314 shows a variation in this configuration to control the amount of coolant flow.

Figure 14:
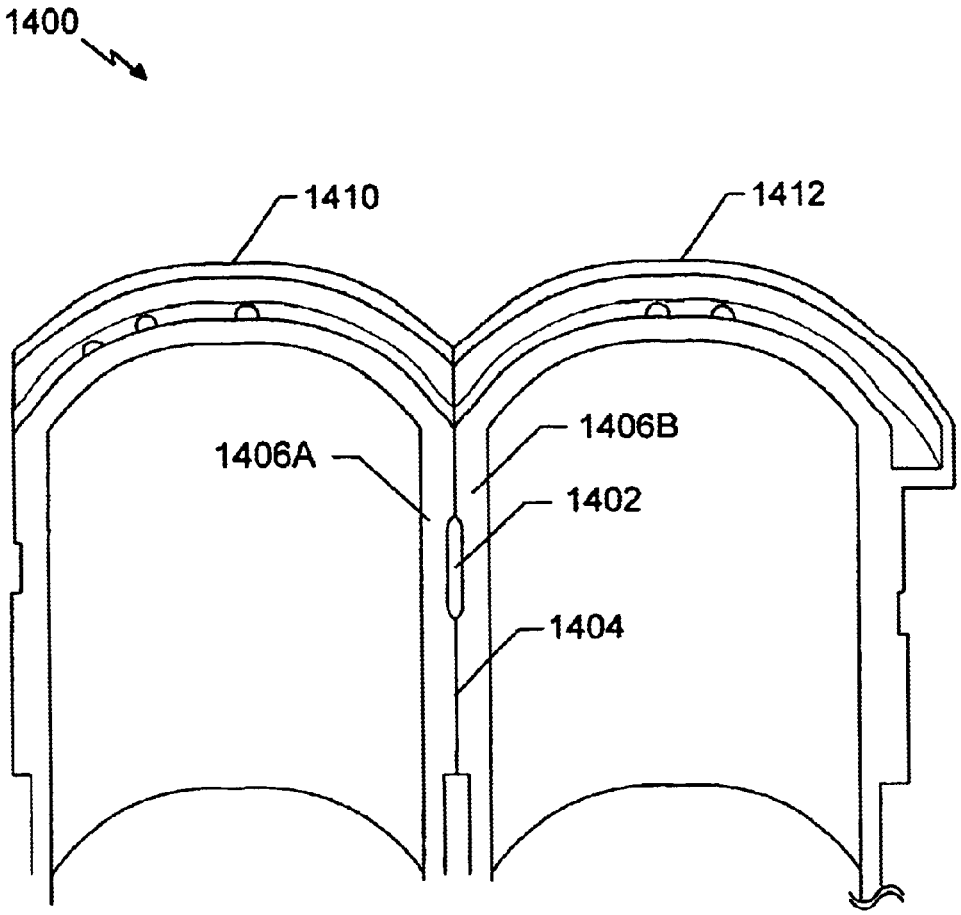
FIG. 14 is another embodiment of the siamesed cylinder sleeves.

FIG. 14 is another embodiment 1400 of siamesed cylinder sleeves 1410. 1412. In the illustrated embodiment, a lateral groove or passageway 1402 is constructed within one or both of the outer surfaces 1406A, 1406B of the sleeves, at the joining point 1404 between the sleeves 1410 and 1412. When the adjacent sleeves 1410, 1412 are fitted together, the passageway 1402 that is formed enables the coolant to pass between the sides of the sleeves 1410, 1412. For example, FIG. 13 shows a lateral groove 1330 in phantom that is similar to the groove 1402 that enables the coolant to pass from one side 1332 of the cylinders to another side 1334. In a further embodiment, there may be more than one lateral groove 1402 formed on the outer surface of the sleeves 1410, 1412.

Figure 15:
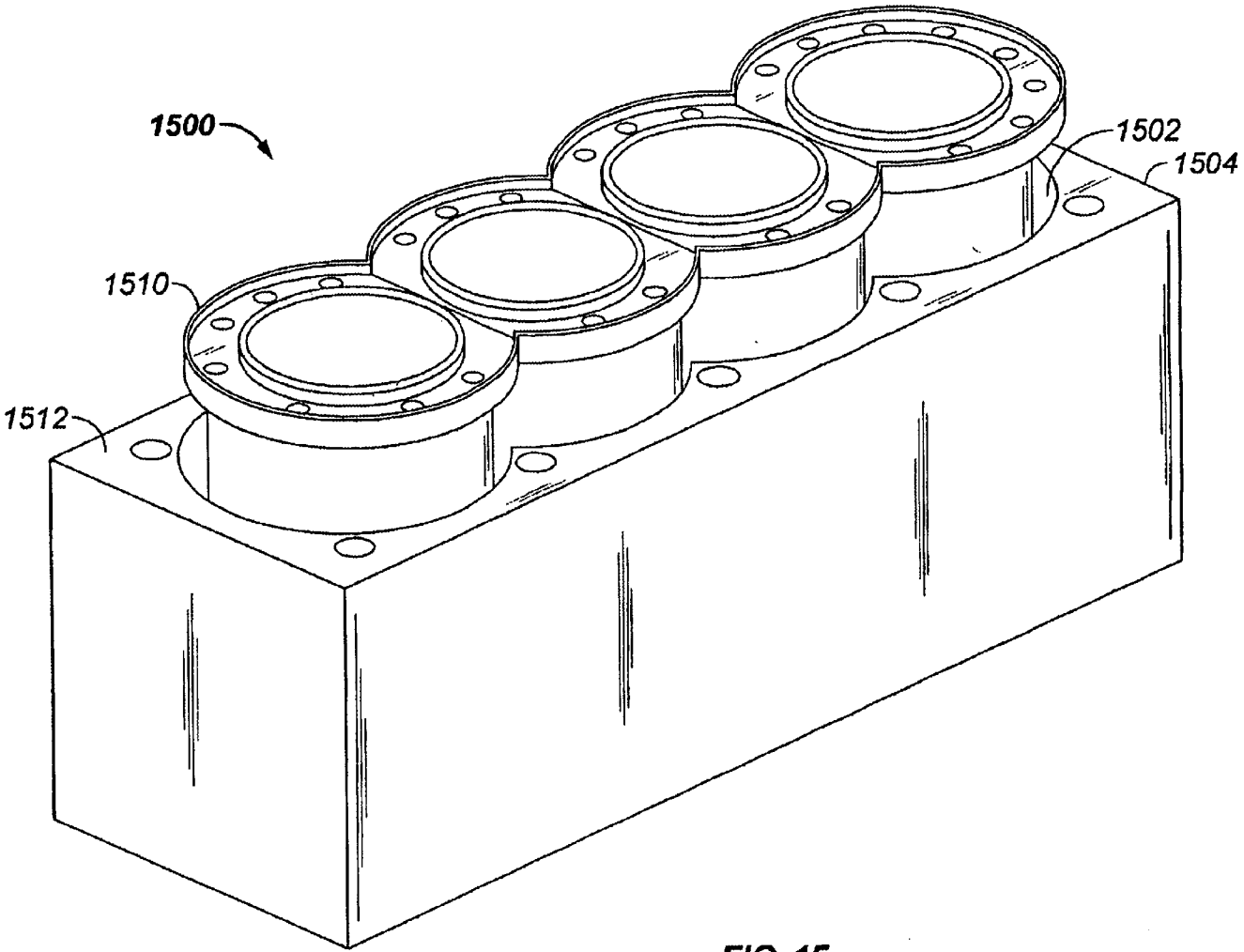
FIG. 15 is a side perspective view of a plurality of successively-aligned siamesed cylinder sleeves being inserted into a cylinder bore of an engine block in accordance with an embodiment of the invention.

FIG. 15 is a side perspective view of a plurality of successively-aligned siamesed cylinder sleeves 1500 being inserted into a cylinder bore 1502 of an engine block 1504 in accordance with an embodiment of the invention. The siamesed cylinder sleeves 1500 are typical of the siamesed sleeves described above. Once the sleeves 1500 have been inserted into the cylinder bore 1502, the top surface 1510 of the sleeves 1500 may become flush with the top deck 1512 (i.e., the top surface) of the engine block 1504.

Figure 16:
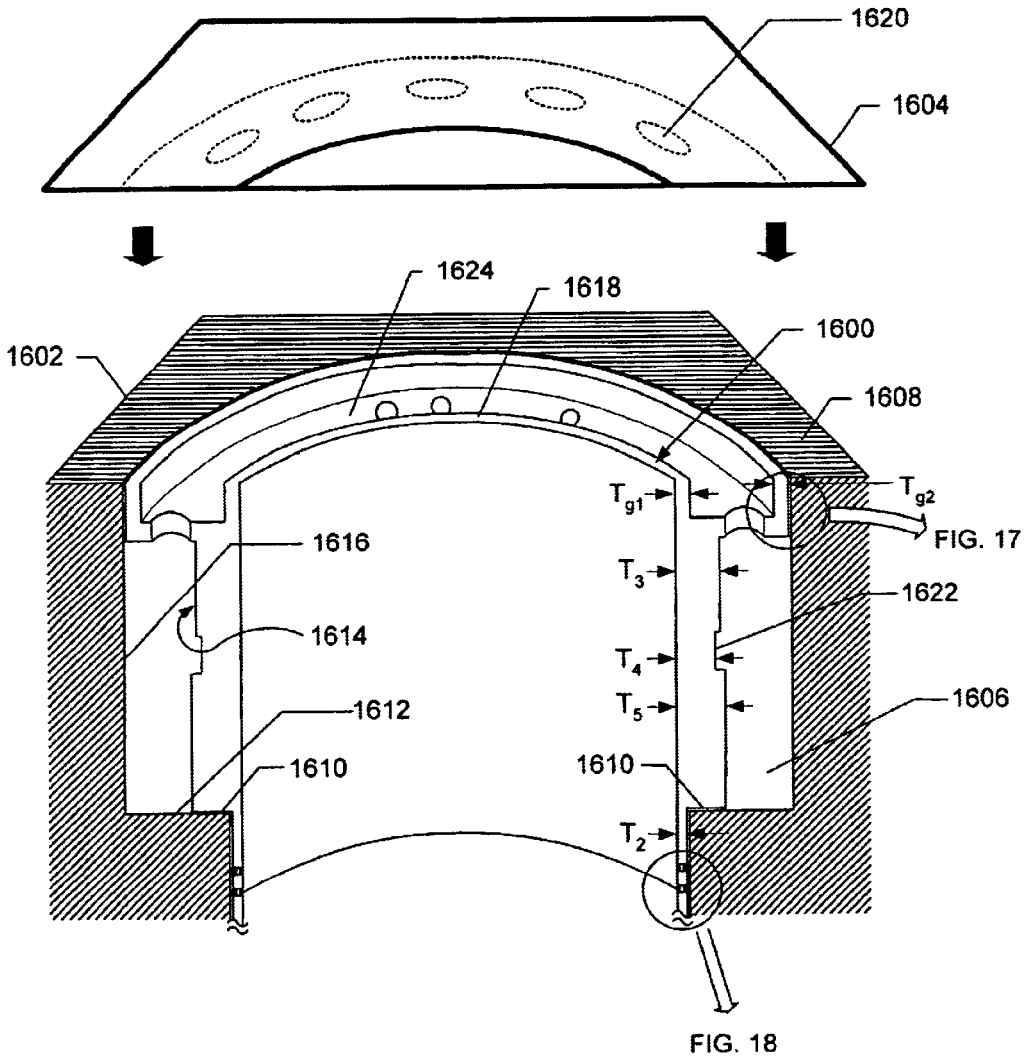
FIG. 16 is a partial cross-sectional perspective view of an exemplary cylinder sleeve incorporated into the cylinder bore with a cylinder head positioned above the cylinder sleeve.

FIG. 16 is a partial cross-sectional perspective view of an exemplary cylinder sleeve 1600 incorporated into a cylinder bore of an engine block 1602 with a cylinder head 1604 positioned above the cylinder sleeve 1600 for mating engagement. When the engine is assembled for operation, the head 1604 rests on top of the block 1602 and an interposed gasket (not shown, for simplicity of illustration). In the illustrated embodiment, the cylinder sleeve 1600 is slidably inserted into a bore of the engine block 1602 from the top surface 1608 of the block 1602. The sleeve 1600 is inserted until a sleeve shoulder 1610 formed on the outer surface 1614 contacts a ledge 1612 in the cylinder bore of the engine block 1602. The shoulder 1610 establishes the axial position (i.e., the vertical position in FIG. 16) of the cylinder sleeve 1600 within the bore of the engine block 1602 so that the top surface of the sleeve 1600 aligns with the top surface 1608 of the engine block 1602. A flange section 1618 that is adjacent to the top portion of the cylinder sleeve 1600 provides a substantially snug fit for the sleeve 1600 inserted into the bore of the engine block 1602 and also provides increased rigidity and strength to the cylinder sleeve 1600, especially to the top portion of the sleeve 1600. Those skilled in the art will understand that FIG. 16 depicts a closed-deck configuration.

The axial position of the cylinder sleeve 1600 enables the flange section 1618, the outer wall 1614 of the cylinder sleeve 1600, and the inner wall 1616 of the engine block to form a coolant chamber 1606 surrounding the substantial portion of the cylinder sleeve 1600. Coolant holes and a groove in the flange section 1618 facilitate the circulation of coolant from the coolant chamber 1606 into and through the groove and into coolant ports 1620 in the cylinder head 1604.

Figure 17:
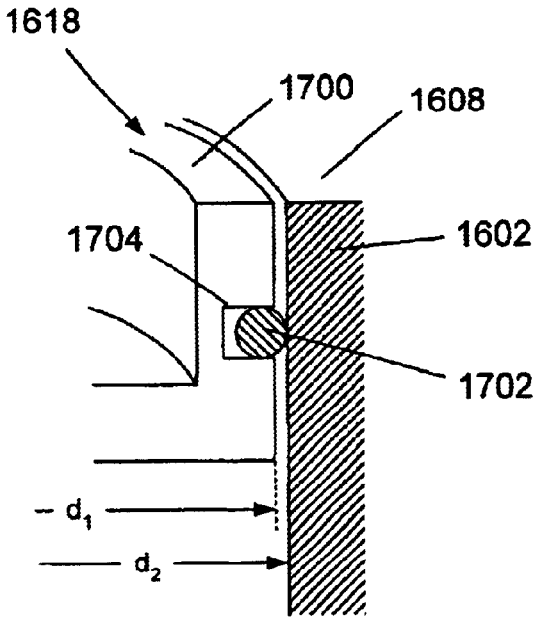
FIG. 17 is a detailed diagram of a gap between the flange and the inner wall of the cylinder bore.

The flange section 1618 includes a first diameter ($d_1$) that is included within a second diameter ($d_2$) of the engine block 1602 when the cylinder sleeve 1600 is installed in the block 1602 (see FIG. 17). There may be a clearance fit of approximately 0.001" to 0.002" in diameter clearance between the first diameter and the second diameter. In one embodiment, a circumferential seal recess 1704 is formed within an outer wall 1700 of the flange section 1618. Located within the recess 1704 is an elastomeric o-ring 1702, which provides a seal from the top surface 1608 of the engine block 1602. The o-ring 1702 functions as a primary seal when the engine is cold. As the engine is operated and the sleeve 1600 and the engine block 1602 become hotter, clearance between the first diameter and the second diameter is lost. When the engine is warmed up, the diameters come into contact to form a seal between the coolant chamber 1606 and the cylinder head 1604. Thus, the o-ring 1702 functions as a redundant seal when the engine is warmed up. Although the o-ring 1702 is elastomeric in the illustrated embodiment, other materials known in the art may be substituted.

Figure 18:
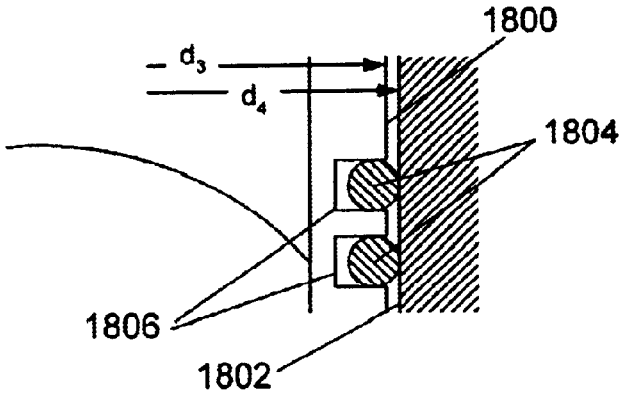
FIG. 18 is a detailed diagram of a lower mating region of a cylinder sleeve.

Referring to FIG. 18, a lower mating region 1800 is located below the sleeve shoulder 1610 (see FIG. 16) on the outer surface 1614 of the cylinder sleeve 1600, having a third diameter of $d_3$. This lower mating region 1800 is slidably inserted into the bore of the engine block 1602 and contacts the lower inner surface 1802 of the cylinder bore, which has a fourth diameter of $d_4$. Since the diameter $d_3$ may be slightly smaller than or substantially similar to the diameter $d_4$, a force may need to be applied to the cylinder sleeve 1600 as the sleeve 1600 is inserted into the cylinder bore of the engine block 1602 to overcome the sliding resistance. The tightness of the fit provided by the small difference in the diameters results in a substantially leak-tight seal. However, additional sealing may be provided with o-rings 1804 inserted within grooves 1806 (see FIG. 18).

Returning to the exemplary embodiment of FIG. 16, the dimensions of the wall surfaces in the cylinder sleeve 1600 are configured so that a slight depression 1622 is formed on the outer surface of the cylinder sleeve 1600. The depression 1622 can be configured similarly to the lateral groove 1402 shown in FIG. 14, or can be configured as a depression formed around a substantial portion of the circumference of the outer surface 1614. The depression 1622 allows coolant to efficiently flow from the chamber 1606 through the outer surfaces of the cylinder sleeve 1600, the flange section 1618, and into the coolant ports 1620 of the cylinder head 1604. In this way, the depression 1622 functions similarly to the lateral passageway 1402 of FIG. 14.

In the illustrated embodiment of FIG. 16, the vertical walls of the flange section 1618 are configured so that the thickness of the inner wall ($T_{g1}$) and/or the thickness of the outer wall ($T_{g2}$) are less than the thickness ($T_2$) of the lower portion of the cylinder sleeve 1600 that fits into the bore of the engine block 1602. This enables the groove 1624 of the flange section 1618 to be configured as wide as possible while providing sufficient stability and rigidity to the upper and lower portions of the cylinder sleeve 1600.

The formation of the depression 1622 in the sleeve 1600 allows the wall thickness of the cylinder sleeve to be varied along the outer surface that is in communication with coolant in the coolant chamber 1606. Hence, in the illustrated embodiment, the thickness ($T_4$) of the wall in the depression 1622 is the thinnest, and the thickness ($T_3$) of the wall adjacent to the flange section 1618 is thicker than $T_4$, while the thickness ($T_5$) of the wall adjacent to the sleeve shoulder 1610 has the greatest thickness. In another embodiment, the thickness $T_3$ can be configured to be larger than the thickness $T_5$. The differential thickness of $T_3$ and $T_5$ enables the sleeve to be configured as thin as possible while providing sufficient stability and rigidity to the sleeve.

Figure 19:
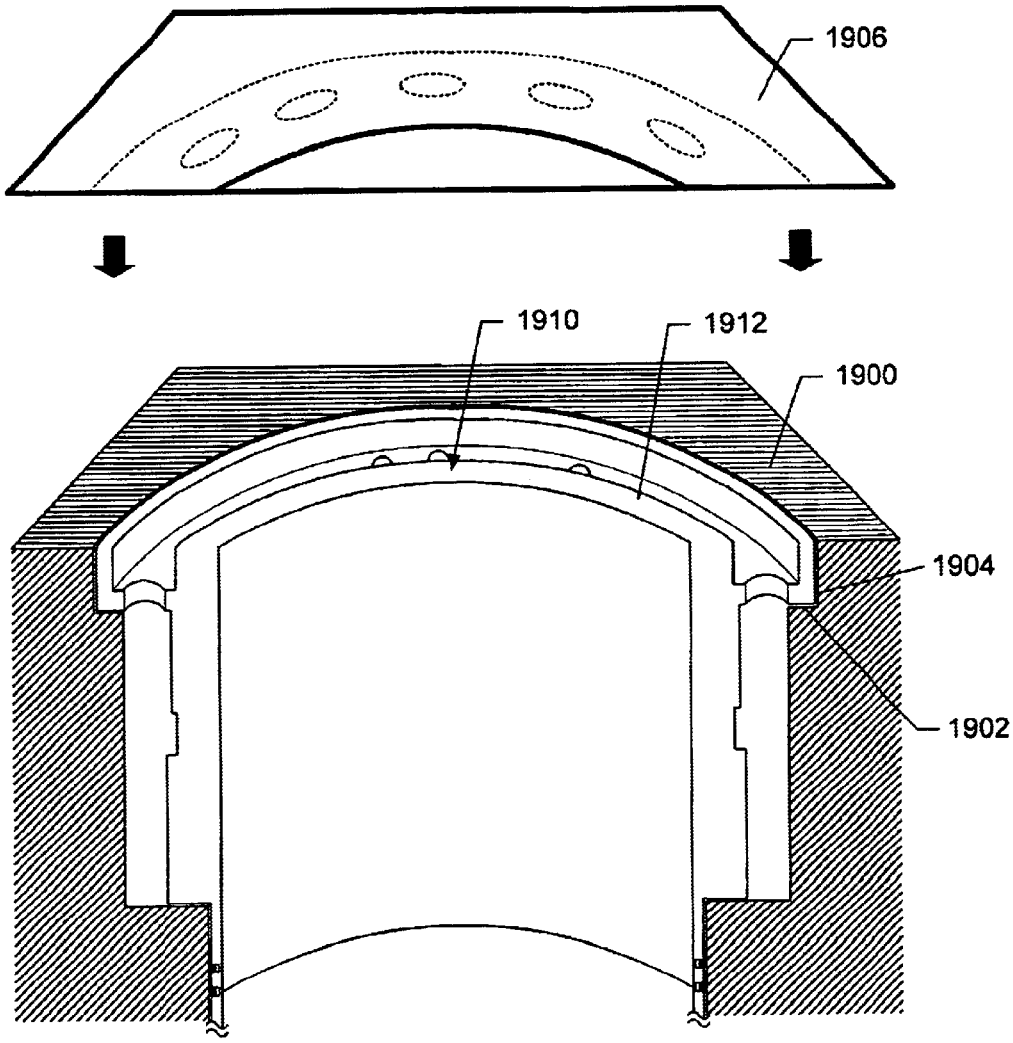
FIG. 19 illustrates an alternative embodiment of an internal combustion engine having an engine block adapted to receive a cylinder sleeve in accordance with the invention.

FIG. 19 illustrates an alternative embodiment of an internal combustion engine having an engine block 1900 adapted to receive a cylinder sleeve 1910. A cylinder head 1906 is mated with the sleeve 1910 when the engine is assembled. In the illustrated alternative embodiment, a top ledge 1902 is formed in the upper inner wall 1904 of the engine block 1900. The top ledge 1902 provides an extra measure of rigidity to the cylinder sleeve 1910 by providing a support for the flange section 1912.

Figure 20:
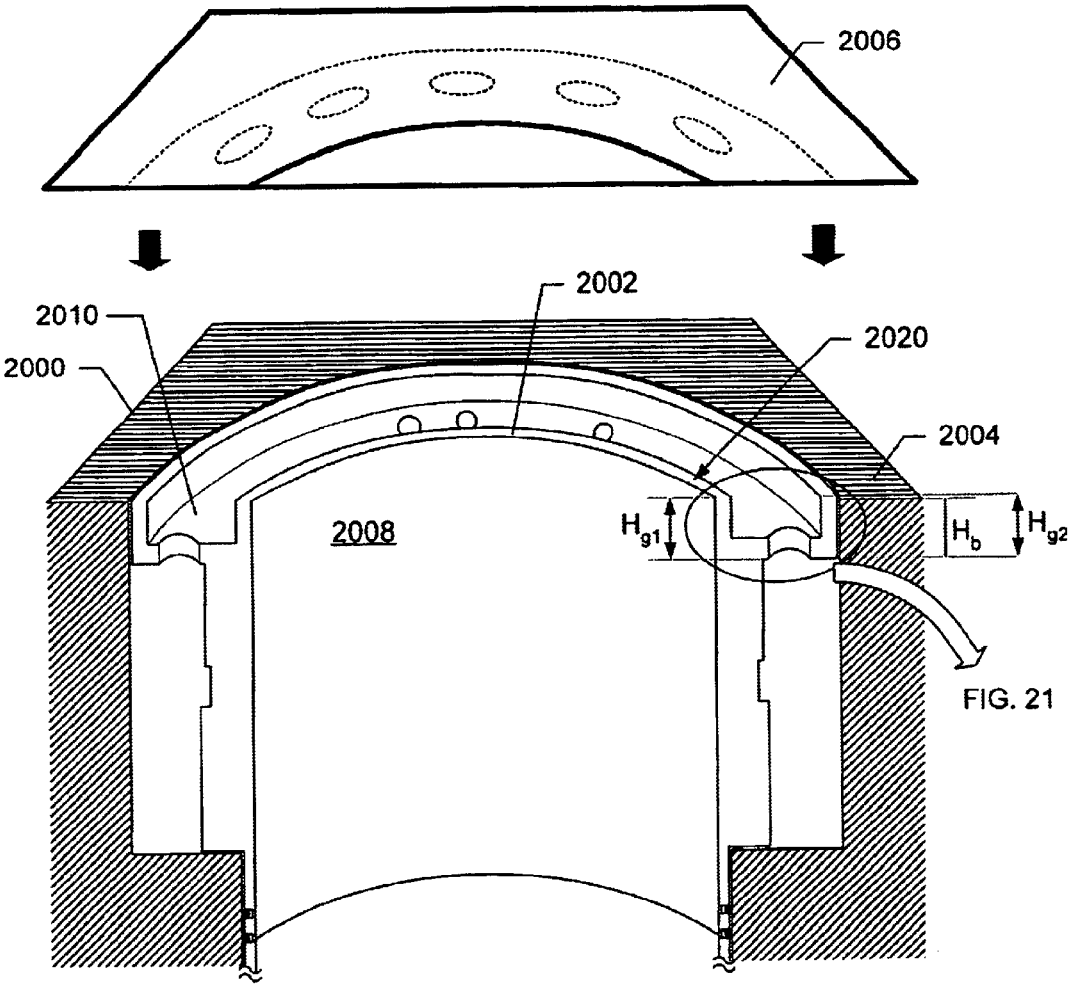
FIG. 20 illustrates another alternative embodiment of an internal combustion engine having an engine block adapted to receive a cylinder sleeve in accordance with the invention.

FIG. 20 shows another alternative embodiment of an internal combustion engine having an engine block 2000 adapted to receive a cylinder sleeve 2020. The cylinder sleeve 2020 of the illustrated alternative embodiment is configured to have a flange section 2002 with a groove 2010 whose inner and outer wall heights are different. The wall heights are configured so that when a gasket/cylinder head 2006 is placed on top of the engine block 2000 including the cylinder sleeve 2020, the head 2006 engages (or presses against) the top surface of the inner wall first before the head 2006 engages the top surface of the outer wall. Furthermore, the gasket/cylinder head 2006 engages the top deck 2004 of the engine block 2000 subsequent to the engagement with the top surface of the outer wall.

In the illustrated embodiment, the inner wall height ($H_{g1}$) is configured to be slightly higher than the outer wall height ($H_{g2}$), and the outer wall height ($H_{g2}$) is configured to be slightly higher than the top surface or the top deck 2004 of the engine block 2000. This configuration provides improved sealing between the sleeve 2020 and the cylinder head 2006, especially when the engine is running, by better maintaining the shape of the cylinder sleeve 2020 as cylindrical as possible (i.e., the cross section of the cylinder sleeve is kept substantially circular). The maintenance of the cylindrical shape enhances the combustion process and substantially reduces any gaseous leakage around the piston rings as the piston is moving vertically within the sleeve 2020. Therefore, the maintenance of the cylindrical shape substantially reduces any adverse effect leakage may have on engine emissions and reduces pollutants.

Figure 21:
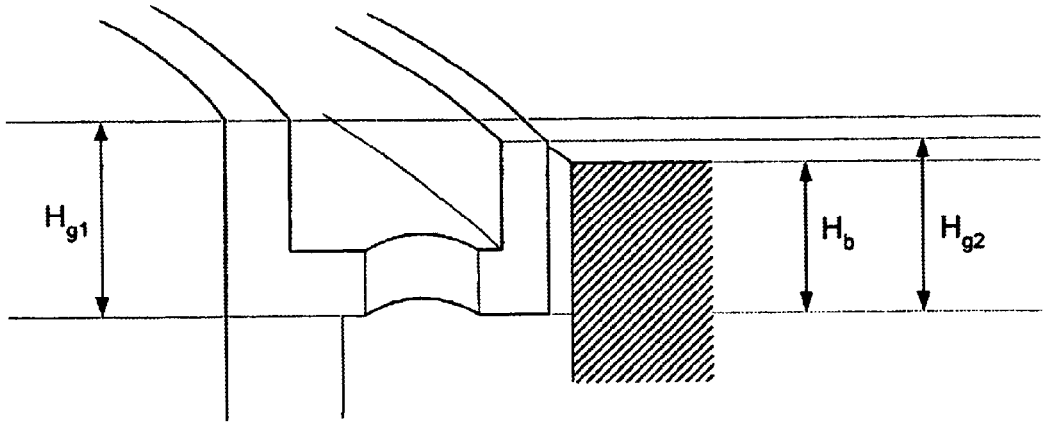
FIG. 21 illustrates in detail relative dimensions in the alternative embodiment of FIG. 20.

FIG. 21 shows the distance ($H_b$) from the top surface 2004 of the engine block 2000 to the lower outer surface of the groove 2010. Thus, top surfaces of the walls of the flange section are not flush with the top surface 2004 of the engine block 2000. Typical relative dimensions can be configured with the inner wall height ($H_{g1}$) approximately 0.005" above the engine block top surface 2004 and the outer wall height ($H_{g2}$) approximately 0.0025" above the engine block top surface. It should be noted that the above dimensions represent only typical relative dimensions and that the actual relative dimensions may be configured differently. FIG. 21 illustrates the relative dimensions in detail.

Figure 22:
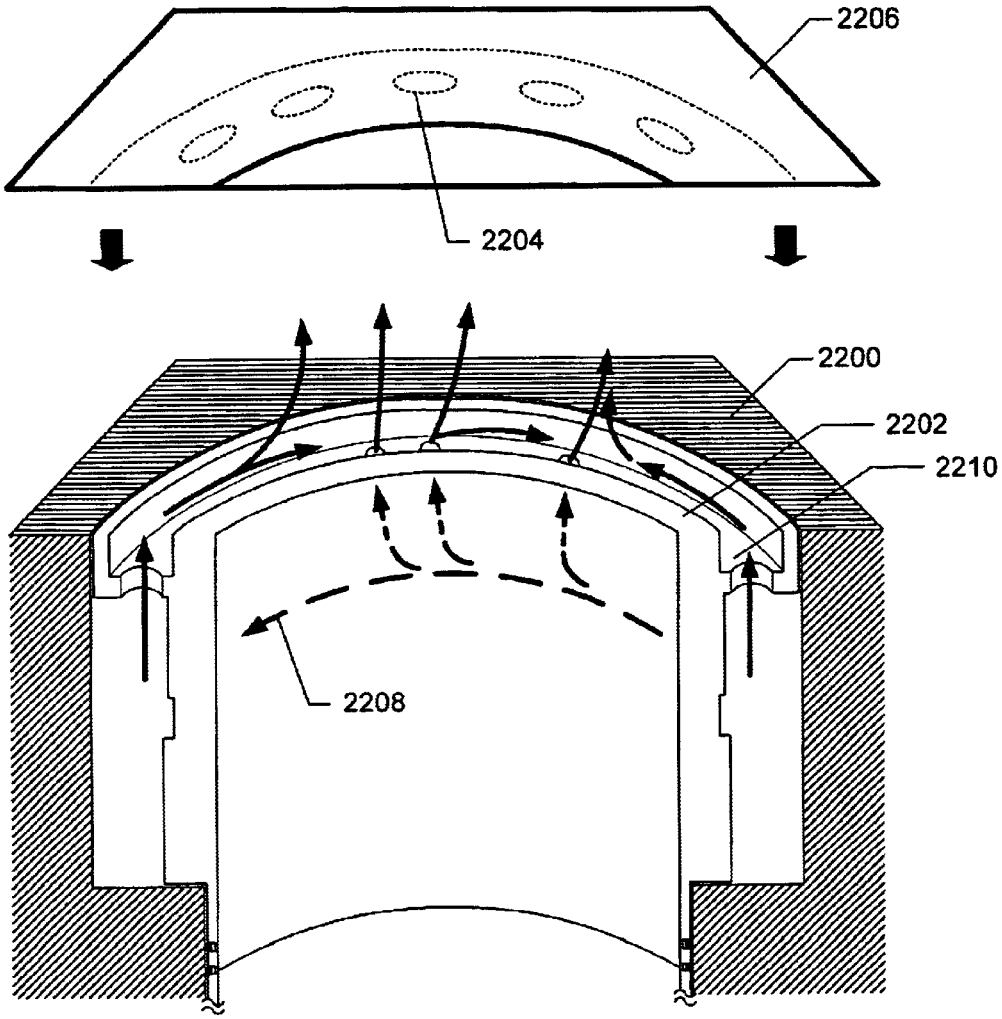
FIG. 22 shows a flow of coolant through a cylinder sleeve and a cylinder head in accordance with an exemplary embodiment.

FIG. 22 illustrates a flow of coolant 2208 within an engine block 2200, about the outer surface of a cylinder sleeve 2202, and into coolant ports 2204 in a cylinder head 2206 in accordance with an exemplary embodiment. The coolant ports 2204 in the cylinder head 2206 may individually and collectively be configured with respect to the groove 2210 and the coolant holes to effectively channel the flow of coolant 2208 about the upper portion of the cylinder sleeve 2202 and into the cylinder head 2206. Using the Bernoulli relationship between the fluid velocity and pressure, head pressure within the groove and the cylinder head can be adjusted by controlling the number, the size, and the grouping of the coolant holes in the flange and the coolant ports in the cylinder head 2206. Furthermore, the size of the groove 2210 can be adjusted to efficiently control the flow of coolant and to provide uniform temperature distribution. In the exemplary embodiments of the present invention, the flow of coolant in each sleeve can be directed to flow in a different direction by positioning the holes accordingly. Thus, the cooling requirements of each cylinder sleeve can be individually met.

Figure 23:
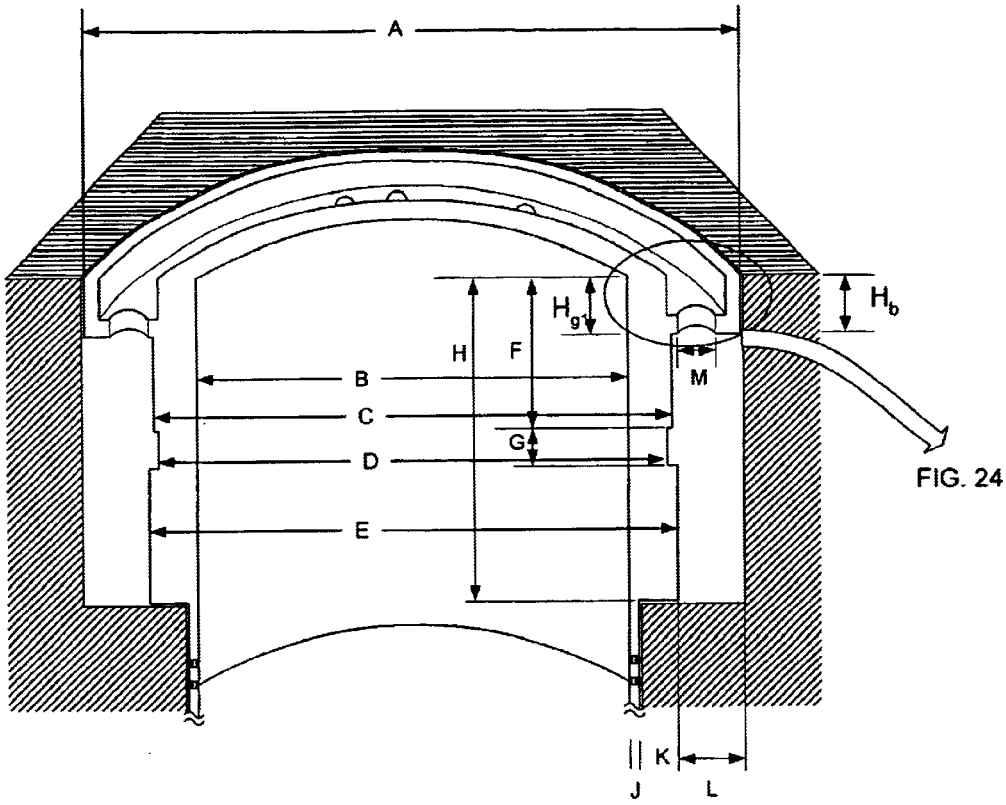
FIGS. 23 and 24 shows dimensions for exemplary embodiments of the invention.
Figure 24:
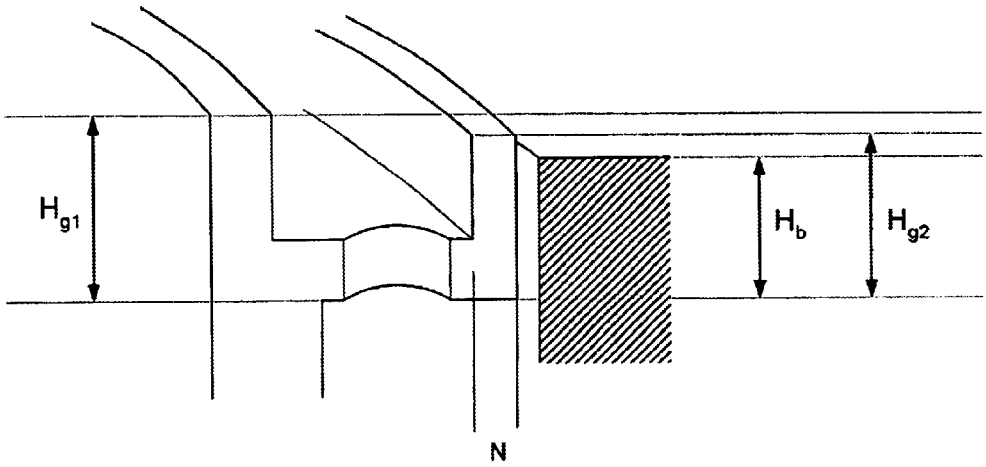

Dimensions for exemplary embodiments of the invention as shown in FIGS. 23 and 24 are given in Table 1. However, it should be noted that the dimensions tabulated in Table 1 represent only typical examples. Accordingly, it should be understood that the dimensions of the exemplary cylinder sleeves and engine blocks may vary significantly from the dimensions shown in Table 1.

TABLE 1

| Dimension Label | Typical Dimension (inches) |
|---|---|
| A | 5.180 |
| B | 4.000 |
| C | 4.600 |
| D | 4.570 |
| E | 4.605 |
| F | 1.450 |
| G | 1.560 |
| H | 3.375 |
| J | 0.141 |
| K | 0.319 |
| L | 0.575 |
| M | 0.187 |
| N | 0.070 |
| $H_b$ | 0.5975 |
| $H_{g1}$ | 0.6025 |
| $H_{g2}$ | 0.600 |

Figure 25:
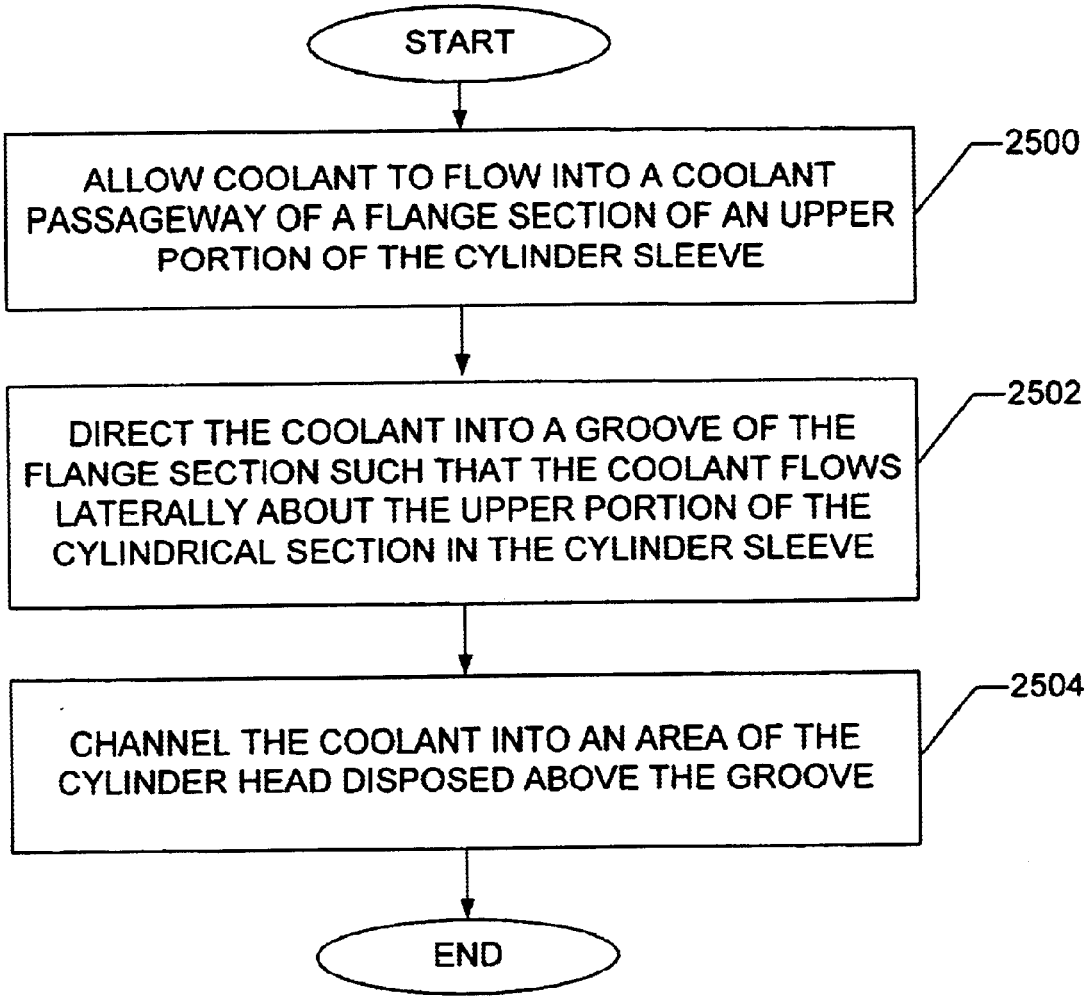
FIG. 25 is a flowchart illustrating a method for cooling the highly heated portions of a cylinder sleeve and a cylinder head in accordance with an exemplary embodiment of the invention.

FIG. 25 is a flowchart illustrating a method for cooling the highly heated portions of a cylinder sleeve and a cylinder head in accordance with an exemplary embodiment of the invention. At 2500, coolant is allowed to flow into a coolant passageway of a flange section of an upper portion of the cylinder sleeve. In the exemplary embodiment, the coolant holes in the groove are used to control the flow of coolant into the groove. In other embodiments, the flow of coolant into the groove may be controlled by configuring gaps in outer walls of the groove. The coolant is directed, at 2502, into a groove of the flange section such that the coolant flows laterally about the upper portion of the cylindrical section in the cylinder sleeve. In one embodiment, the coolant may be laterally directed about the upper portion using an extension to the outer wall of the groove. The coolant is then channeled into an area of the cylinder head disposed above the groove, at 2504.

Figure 26:
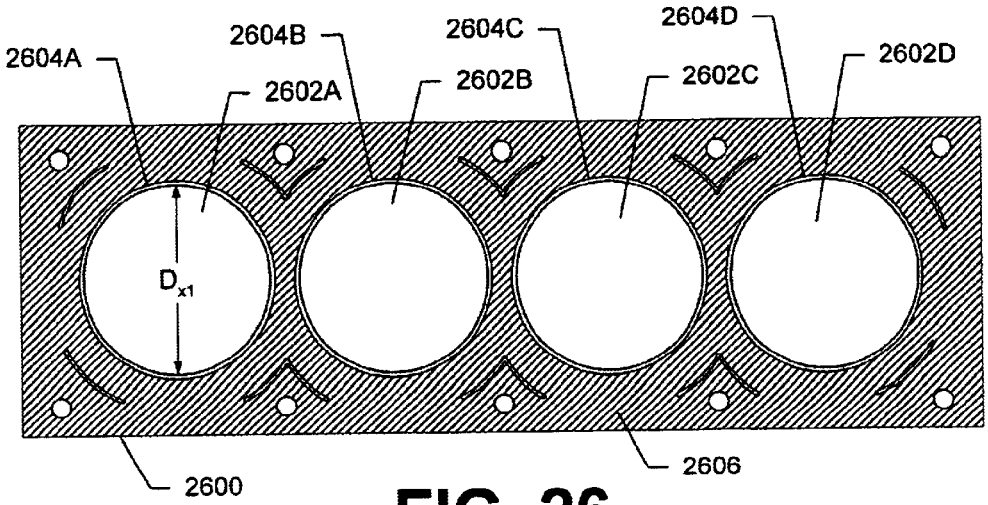
FIG. 26 (PRIOR ART)
FIG. 26 illustrates a typical conventional closed-deck engine block adapted for an internal combustion engine.

FIG. 26 illustrates a typical conventional closed-deck engine block 2600 adapted for an internal combustion engine. The engine is illustrated with four cylinder bores 2602A, 2602B, 2602C, 2602D (collectively referred to as 2602). A plurality of sleeves 2604A, 2604B, 2604C, 2604D (collectively referred to as 2604), respectively, have been inserted into the cylinder bores 2602 to form cylinder openings of diameter $D_{x1}$. The sleeves 2604 are typically made of cast iron and are circumferentially ribbed. The block may be cast around the sleeves. The closed-deck engine block 2600 can be suitable for use in multi-cylinder engines of a high power output capability since the deck 2606, serving as a surface for attachment to the cylinder head, is of high rigidity and the durability of the gasket inserted between the engine block 2600 and the cylinder head is increased. However, limitations for increasing the power output include the limited size of the cylinder sleeve 2604 that also limits the diameter $D_{x1}$ of the cylinder opening, and the complexity of replacing the cylinder sleeve 2604, which may be impractical.

Figure 27:
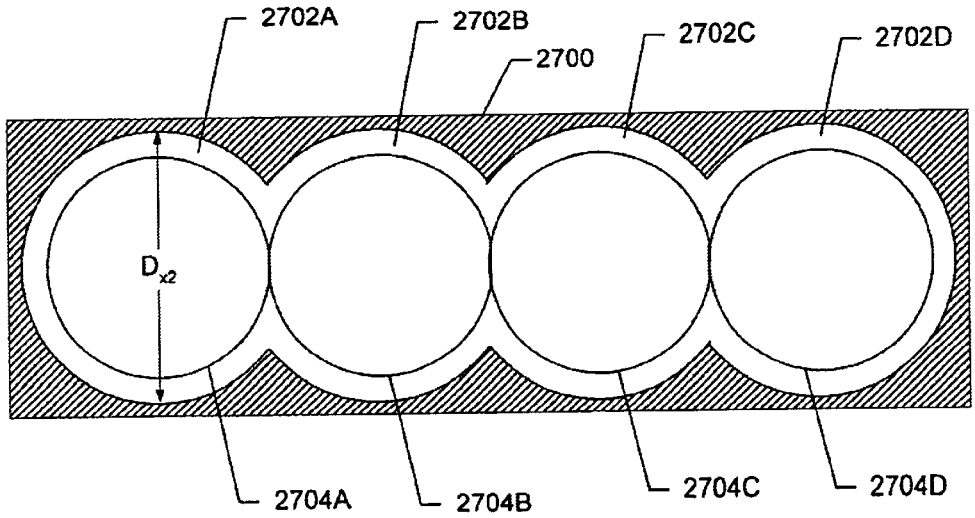
FIG. 27 illustrates an exemplary closed-deck engine block adapted for an internal combustion engine modified from the conventional closed-deck engine block shown in FIG. 26.

To overcome some of the difficulties presented by the conventional closed-deck engine block 2600 shown in FIG. 26, the engine block 2600 may be modified as shown in FIG. 27 to receive a plurality of cylinder sleeves (e.g., the sleeves 1100 and 1300 shown in FIGS. 11 and 13), each sleeve capable of being received in a cylinder opening with substantially larger diameter $D_{x2}$ (FIG. 27). That is, the block 2600 can be bored out to provide cylinder bores and an upper block that can receive the sleeves 1100, 1300. The resulting engine block 2700 shown in FIG. 27 is similar to the engine block 800 of FIG. 8. Because the engine block 2700 was modified from a closed-deck engine block 2600 having coolant flowing in gaps 2702A, 2702B, 2702C, 2702D between elevated wall surfaces 2704A, 2704B, 2704C, 2704D and inner surfaces of the bores, the elevated wall surfaces 2704 form a plurality of elevated walls, unless the elevated walls 2704 are machined down to the bottom of the gaps 2702. However, it might not be possible to machine the walls 2704 down to the bottom of the gaps 2702 because the machining process might punch through the sidewalls of the block thickness at the bottom of the block. The elevated walls 2704 may act as ledges for support shoulders of the cylinder sleeves.

Accordingly, the closed-deck engine 2600 can be reconfigured so that the resulting engine block 2700 can be configured with a single cavity opening that enables siamesed cylinder sleeves 1100 or 1300 to be inserted into the cavity of the engine block 2700, similar to that shown in FIG. 15. Furthermore, this resulting engine block 2700 provides advantages including increased bore size, increased strength, more efficient cooling, and relatively easy field serviceability of the sleeves, for a high-performance internal combustion engine.

Figure 28:
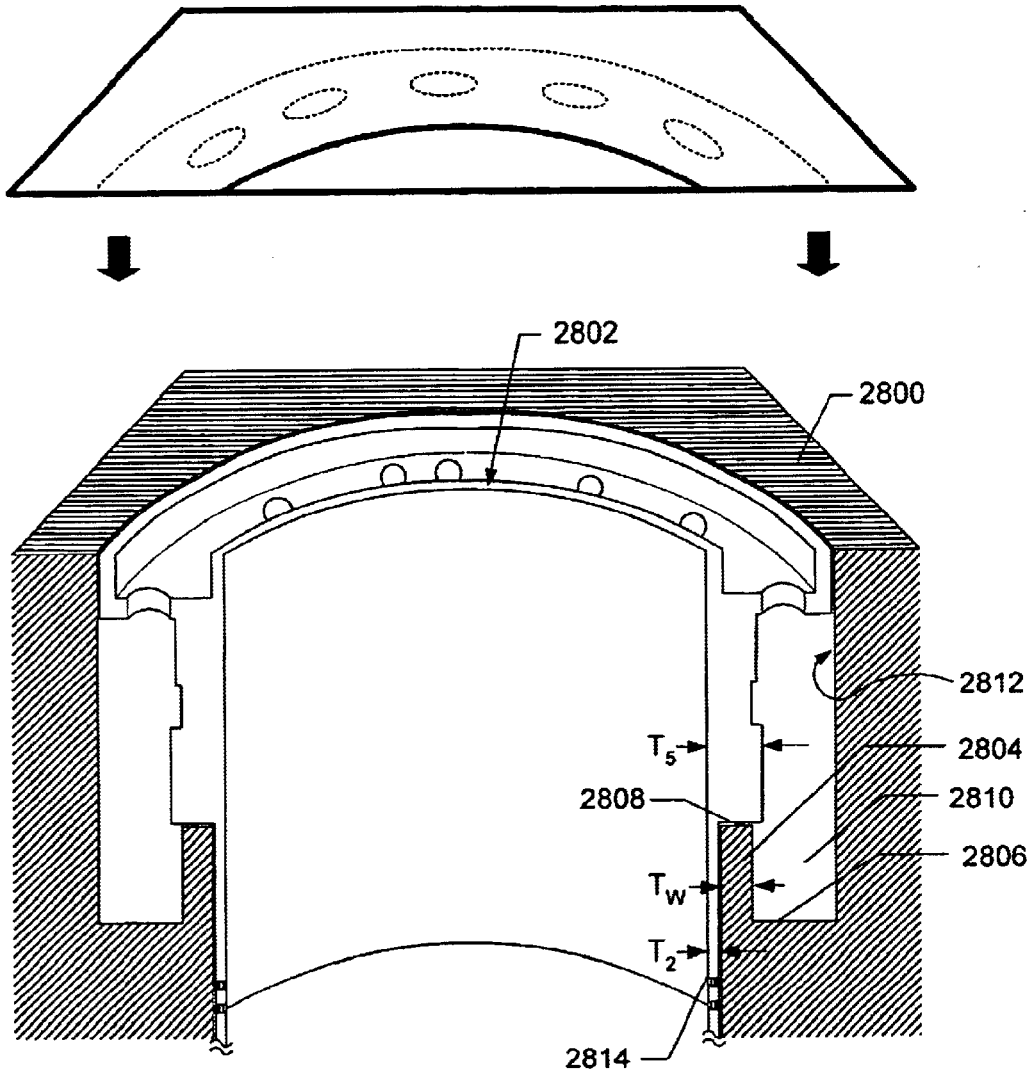
FIG. 28 shows a partial cross-sectional perspective view of an exemplary modified closed-deck engine block adapted to receive a cylinder sleeve.

FIG. 28 shows a partial cross-sectional perspective view of an exemplary modified closed-deck engine block 2800 adapted to receive a cylinder sleeve 2802. In the illustrated embodiment, the modified engine block 2800 includes an elevated wall 2804 formed on a ledge 2806 of the engine block 2800 so that the wall 2804 provides a support for a shoulder 2808 of the cylinder sleeve 2802. The elevated wall 2804 is the result of the machining down of the closed-deck block 2600 shown in FIG. 26. In one optional embodiment, a cavity 2810 formed between the elevated wall 2804 and the inner surface 2812 of the engine block 2800 can be filled with a block cement such as special high temperature epoxy resin or block filler material. This may provide further strength to the wall 2804, and also enables more efficient cooling by keeping the coolant more toward the upper portion of the sleeve 2802 where the sleeve 2802 becomes hotter during engine operation.

Further, the dimensions of the wall surfaces in the cylinder sleeve 2802 can be adjusted to provide additional strength and rigidity to the sleeve 2802. For example, in the illustrated embodiment of FIG. 28, the wall thickness ($T_5$) above the shoulder 2808 of the sleeve 2802 is configured to be larger than the combined thickness ($T_2$+$T_w$) of the lower portion 2814 of the sleeve 2802 and the elevated wall 2804.

Figure 29:
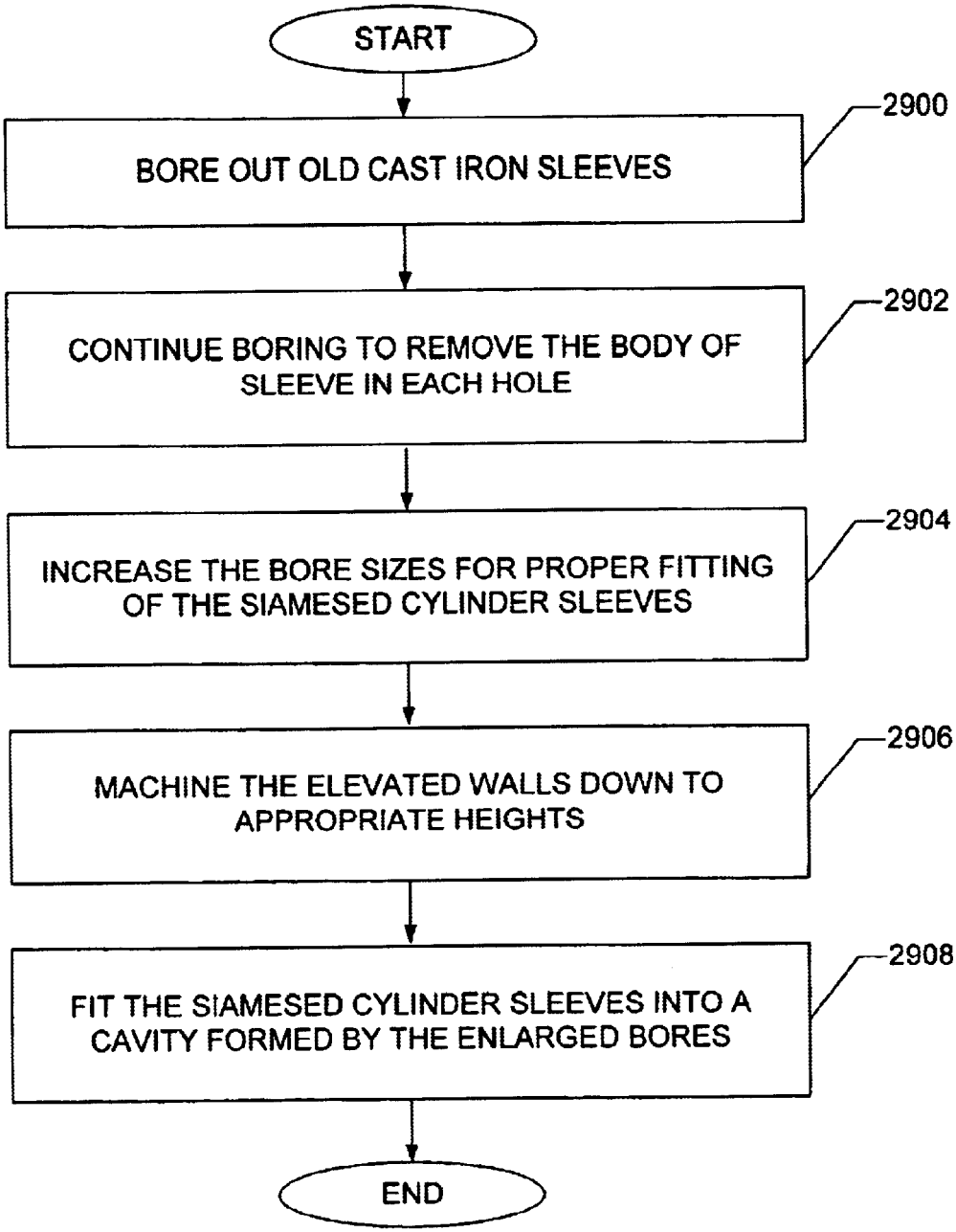
FIG. 29 is a flowchart illustrating an exemplary process for modifying a conventional closed-deck engine block to generate a high-performance internal combustion engine.

FIG. 29 is a flowchart illustrating an exemplary process for modifying a conventional closed-deck engine block from the FIG. 26 configuration to the FIG. 27 configuration to receive sleeves such as described above and generate a higher performing internal combustion engine. Initially, the conventional closed-deck engine block is provided to bore out the old cast iron sleeves, at 2900. A boring operation is performed to remove the body of the sleeve in each hole, at 2902. The bore sizes are thereby increased, at 2904, for proper fitting of the siamesed cylinder sleeves 1100 or 1300. At 2906, the cylinders are machined down to appropriate heights to form the elevated walls 2704. The siamesed cylinder sleeves are then fitted into a cavity formed by the enlarged bores, at 2908.

While specific embodiments of the invention have been illustrated and described, such descriptions have been for purposes of illustration only and not by way of limitation. For example, although the exemplary process for modifying a conventional engine block to generate a higher performing engine has been presented for a process that start with a closed-deck engine, an open-deck engine can also be used. The present invention should therefore not be seen as limited to the particular embodiment described herein, but rather, it should be understood that the present invention has wide applicability with respect to engine designs generally. Throughout this detailed description, for the purposes of explanation, numerous specific details were set forth in order to provide a thorough understanding of the present invention. It will be apparent, however, to one skilled in the art that the embodiments may be practiced without some of these specific details. For example, although the groove is shown herein configured within the flange of the cylinder sleeve, the groove may be formed directly within the wall of the cylindrical section in the upper portion of the cylinder sleeve. Hence, the sleeve may be configured without a flange. In other instances, well-known structures and functions were not described in elaborate detail in order to avoid obscuring the subject matter of the present invention. Accordingly, all modifications, variations, or equivalent arrangements and implementations that are within the scope of the attached claims should therefore be considered within the scope of the invention.

What is claimed is:

1. A cylinder sleeve for an internal combustion engine having an engine block and a cylinder head, the cylinder sleeve comprising:

a cylindrical section having a top portion and a bottom portion, the cylindrical section configured to receive a cylinder piston that reciprocates in the block, wherein the top portion is configured to mate with the cylinder head; and a flange section adjacent to the top portion of the cylindrical section, the flange section configured with a coolant groove that permits coolant to flow directly into the cylinder head, and at least one coolant passageway that provides an opening for coolant to pass into the coolant groove of the flange section.

2. A cylinder sleeve as defined in claim 1, wherein the coolant groove extends circumferentially about the cylindrical section within the flange.

3. A cylinder sleeve as defined in claim 1, wherein the cylindrical section includes a radial inner surface that is substantially uniform in diameter.

4. A cylinder sleeve as defined in claim 1, wherein the cylinder sleeve includes at least one straight section along a longitudinal axis to enable the cylinder sleeve to be coupled to at least one other cylinder sleeve.

5. A cylinder sleeve for an internal combustion engine having an engine block and a cylinder head, the cylinder sleeve comprising:

a cylindrical section having a top portion and a bottom portion, the cylindrical section configured to receive a cylinder piston that reciprocates in the block, wherein the top portion is configured to mate with the cylinder head; and a flange section adjacent to the top portion of the cylindrical section, the flange section configured with a coolant groove and at least one coolant passageway that provides an opening for coolant to pass into the coolant groove of the flange section, wherein the coolant groove includes a plurality of partial grooves.

6. A cylinder sleeve as defined in claim 5, wherein the plurality of partial grooves are separated by at least one solid radial region.

7. A cylinder sleeve for an internal combustion engine having an engine block and a cylinder head, the cylinder sleeve comprising:

a cylindrical section having a top portion and a bottom portion, the cylindrical section configured to receive a cylinder piston that reciprocates in the block, wherein the top portion is configured to mate with the cylinder head; and a flange section adjacent to the top portion of the cylindrical section, the flange section configured with a coolant groove and at least one coolant passageway that provides an opening for coolant to pass into the coolant groove of the flange section, wherein the cylinder sleeve includes at least one straight section along a longitudinal axis to enable the cylinder sleeve to be coupled to at least one other cylinder sleeve, wherein the flange also includes an outer wall about the coolant groove.

8. A cylinder sleeve as defined in claim 7, wherein the outer wall of the flange extends circumferentially from one end to another end of the at least one straight section.

9. A cylinder sleeve as defined in claim 8, further comprising:

an extension wall along at least a portion of the at least one straight section.

10. A cylinder sleeve as defined in claim 7, wherein the outer wall of the flange extends circumferentially from a point that is a first distance away from one end of the at least one straight section to another end of the at least one straight section, which leaves a gap at the end of the circumferentially-extending outer wall.

11. A cylinder sleeve as defined in claim 7, further comprising:

a circumferential seal recess formed on the outer wall of the flange.

12. A cylinder sleeve as defined in claim 11, further comprising:

an elastomeric o-ring configured to be disposed within the circumferential seal recess.

13. A cylinder sleeve for an internal combustion engine having an engine block and a cylinder head, the cylinder sleeve comprising:

a cylindrical section having a top portion and a bottom portion, the cylindrical section configured to receive a cylinder piston that reciprocates in the block, wherein the top portion is configured to mate with the cylinder head; and a flange section adjacent to the top portion of the cylindrical section, the flange section configured with a coolant groove and at least one coolant passageway that provides an opening for coolant to pass into the coolant groove of the flange section, wherein the cylinder sleeve includes at least one straight section along a longitudinal axis to enable the cylinder sleeve to be coupled to at least one other cylinder sleeve, further comprising:

a partial coolant hole formed on the at least one straight section.

14. A cylinder sleeve for an internal combustion engine having an engine block and a cylinder head, the cylinder sleeve comprising:

a cylindrical section having a top portion and a bottom portion, the cylindrical section configured to receive a cylinder piston that reciprocates in the block, wherein the top portion is configured to mate with the cylinder head; and a flange section adjacent to the top portion of the cylindrical section, the flange section configured with a coolant groove and at least one coolant passageway that provides an opening for coolant to pass into the coolant groove of the flange section, wherein the cylinder sleeve includes at least one straight section along a longitudinal axis to enable the cylinder sleeve to be coupled to at least one other cylinder sleeve, further comprising:

at least one lateral groove formed on the longitudinally-extending at least one straight section.

15. A cylinder sleeve for an internal combustion engine having an engine block and a cylinder head, the cylinder sleeve comprising:

a cylindrical section having a top portion and a bottom portion, the cylindrical section configured to receive a cylinder piston that reciprocates in the block, wherein the top portion is configured to mate with the cylinder head; and a flange section adjacent to the top portion of the cylindrical section, the flange section configured with a coolant groove and at least one coolant passageway that provides an opening for coolant to pass into the coolant groove of the flange section, wherein the flange section includes:

an inner wall having a first height is circumferentially configured inside the coolant groove; and an outer wall having a second height is circumferentially configured outside the coolant groove.

16. A cylinder sleeve as defined in claim 15, wherein the first height of the inner wall is higher than the second height of the outer wall.

17. A cylinder sleeve as defined in claim 16, wherein the second height of the outer wall is higher than a top surface of the engine block.

18. An internal combustion engine, comprising:

an engine block having at least one bore;

a cylinder head configured to be disposed on the engine block; and at least one cylinder sleeve to be inserted into the at least one bore of the engine block, each of the at least one cylinder sleeve including:

a cylindrical section having a top portion and a bottom portion, the cylindrical section configured to receive a cylinder piston that reciprocates in the block, wherein the top portion is configured to mate with the cylinder head, and a flange section adjacent to the top portion of the cylindrical section, the flange section configured with a coolant groove that permits coolant to flow directly into the cylinder head, and at least one coolant passageway to provide an opening for coolant to pass into the coolant groove of the flange section.

19. An internal combustion engine as defined in claim 18, further comprising:

a plurality of coolant ports configured within the cylinder head.

20. An internal combustion engine comprising:

an engine block having at least one bore;

a cylinder head configured to be disposed on the engine block; and at least one cylinder sleeve to be inserted into the at least one bore of the engine block, each of the at least one cylinder sleeve including:

a cylindrical section having a top portion and a bottom portion, the cylindrical section configured to receive a cylinder piston that reciprocates in the block, wherein the top portion is configured to mate with the cylinder head, and a flange section adjacent to the top portion of the cylindrical section, the flange section configured with a coolant groove and at least one coolant passageway to provide an opening for coolant to pass into the coolant groove of the flange section, further comprising:

a plurality of coolant ports configured within the cylinder head, wherein the plurality of coolant ports in the cylinder head are configured with respect to the groove and the at least one coolant holes to effectively channel a flow of coolant about the top portion of the cylindrical section, within the flange, and into the cylinder head.

21. An internal combustion engine, comprising:

an engine block having at least one bore;

a cylinder head configured to be disposed on the engine block; and at least one cylinder sleeve to be inserted into the at least one bore of the engine block, each of the at least one cylinder sleeve including:

a cylindrical section having a top portion and a bottom portion, the cylindrical section configured to receive a cylinder piston that reciprocates in the block, wherein the top portion is configured to mate with the cylinder head, and a flange section adjacent to the top portion of the cylindrical section, the flange section configured with a coolant groove and at least one coolant passageway to provide an opening for coolant to pass into the coolant groove of the flange section, wherein each cylinder sleeve includes at least one straight section along a longitudinal axis to enable the cylinder sleeves to be coupled to each other.

22. An internal combustion engine as defined in claim 21, wherein the flange of the cylinder sleeve also includes an outer wall about the coolant groove.

23. An internal combustion engine as defined in claim 22, wherein the outer wall of the flange extends circumferentially from one end to another end of the at least one straight section.

24. An internal combustion engine as defined in claim 23, further comprising:

an extension wall along at least a portion of the at least one straight section to restrict a flow of coolant between grooves of the at least one cylinder sleeve.

25. An internal combustion engine as defined in claim 22, wherein the outer wall of the flange extends circumferentially from a point that is a first distance away from one end of the at least one straight section to another end of the at least one straight section, which leaves a gap at the end of the circumferentially extending outer wall to allow coolant to pass into the grooves of the at least one cylinder sleeve from the bore of the engine block.

26. A cylinder sleeve for an internal combustion engine, the sleeve comprising:

a cylindrical inner surface having a longitudinally extending axis;

an outer surface surrounding the inner surface, the outer surface having a lower mating region and an upper region, wherein the lower mating region is adapted to be at least partially fitted into a cylinder bore of an engine block of the internal combustion engine, and is in communication with a flow of coolant about the outer surface; and at least one coolant passageway in the upper region, wherein the flow of coolant can pass from the outer surface into the passageway for lateral flow in the upper region and from the upper region directly into a cylinder head of the internal combustion engine.

27. A cylinder sleeve as defined in claim 26, wherein the outer surface also includes an upper region that is coupled to the at least one coolant passageway.

28. A cylinder sleeve for an internal combustion engine, the sleeve comprising:

a cylindrical inner surface having a longitudinally extending axis;

an outer surface surrounding the inner surface, the outer surface having a lower mating region and an upper region, wherein the lower mating region is adapted to be at least partially fitted into a cylinder bore of an engine block of the internal combustion engine, and is in communication with a flow of coolant about the outer surface; and at least one coolant passageway in the upper region, wherein the flow of coolant can pass from the outer surface into the passageway for lateral flow in the upper region, further comprising:

a shoulder formed on the outer surface at an intersection between the upper region and the lower mating region.

29. A cylinder sleeve as defined in claim 28, further comprising:

at least one seal groove formed in the lower mating region of the outer surface.

30. A cylinder sleeve as defined in claim 29, further comprising:

at least one o-ring disposed within the at least one seal groove.

31. An internal combustion engine, comprising:

an engine block having at least one bore;

a cylinder head coupled to the engine block, the cylinder head including at least one coolant port; and at least one cylinder sleeve corresponding to the at least one bore of the engine block, each of the at least one cylinder sleeve including:

a cylindrical inner surface having a longitudinally extending axis, an outer surface having a lower mating region that is adapted to be at least partially fitted into a cylinder bore of an engine block of the internal combustion engine, and is in communication with a flow of coolant about the outer surface, and at least one coolant passageway, wherein the flow of coolant can pass from the outer surface into the coolant passageway and directly into at least one coolant port of a cylinder head of the internal combustion engine.

32. An internal combustion engine as defined in claim 31, wherein the outer surface of the cylinder sleeve also includes an upper region that is coupled to the at least one coolant passageway.

33. An internal combustion engine, comprising:

an engine block having at least one bore;

a cylinder head coupled to the engine block, the cylinder head including at least one coolant port; and at least one cylinder sleeve corresponding to the at least one bore of the engine block, each of the at least one cylinder sleeve including:

a cylindrical inner surface having a longitudinally extending axis, an outer surface having a lower mating region that is adapted to be at least partially fitted into a cylinder bore of an engine block of the internal combustion engine, and is in communication with a flow of coolant about the outer surface, and at least one coolant passageway, wherein the flow of coolant can pass from the outer surface into at least one coolant port of a cylinder head of the internal combustion engine, wherein the outer surface of the cylinder sleeve also includes an upper region that is coupled to the at least one coolant passageway, further comprising:

a shoulder formed on the outer surface at an intersection between the upper region and the lower mating region.

34. An internal combustion engine as defined in claim 33, further comprising:

a ledge formed in the bore of the engine block, the ledge configured to provide a support for the shoulder formed on the outer surface of the cylinder sleeve.

35. An internal combustion engine as defined in claim 34, further comprising:

an elevated wall formed on the ledge of the engine block.

36. A cylinder sleeve for an internal combustion engine, the sleeve comprising:

a cylindrical inner surface having a longitudinally extending axis;

an outer surface surrounding the inner surface, the outer surface having a lower mating region and an upper region, wherein the lower mating region is adapted to be at least partially fitted into a cylinder bore of an engine block of the internal combustion engine, and is in communication with a flow of coolant about the outer surface; and passage means for passing the flow of coolant from the outer surface laterally into the upper region, and directly into at least one coolant port of a cylinder head of the internal combustion engine.

37. A cylinder sleeve for an internal combustion engine, the sleeve comprising:

a cylindrical inner surface having a longitudinally extending axis;

an outer surface surrounding the inner surface, the outer surface having a lower mating region and an upper region, wherein the lower mating region is adapted to be at least partially fitted into a cylinder bore of an engine block of the internal combustion engine, and is in communication with a flow of coolant about the outer surface; and passage means for passing the flow of coolant from the outer surface laterally into the upper region, and into at least one coolant port of a cylinder head of the internal combustion engine, wherein the passage means includes a groove for allowing the coolant to flow laterally in the upper region.

38. A cylinder sleeve as defined in claim 37, wherein the passage means includes coolant flow gaps that are configured in an outer wall of the groove.

39. A cylinder sleeve as defined in claim 37, wherein the passage means includes an extension to the outer wall of the groove to restrict the flow of coolant through the groove.

40. A cylinder sleeve as defined in claim 37, wherein the passage means includes at least one coolant hole that corresponds to at least one coolant port of the cylinder head.

41. A cylinder sleeve for an internal combustion engine having an engine block and a cylinder head, the cylinder sleeve comprising:

a cylindrical section having a top portion and a bottom portion, the cylindrical section configured to receive a cylinder piston that reciprocates in the block, wherein the top portion is configured to mate with the cylinder head; and a flange section adjacent to the top portion of the cylindrical section, the flange section configured with a coolant groove and at least one coolant passageway that provides an opening for coolant to pass into the coolant groove of the flange section, the flange section including at least an inner wall height and an outer wall height configured such that when the cylinder head is installed on top of the engine block to seal the cylinder sleeve, the cylinder head engages the inner wall height prior to engaging the outer wall height, wherein such engagement provides tight compression to the cylinder sleeve and maintains a shape of the cylinder sleeve as substantially cylindrical.

42. A cylinder sleeve as defined in claim 41, wherein the inner wall height is higher than the outer wall height.

43. A cylinder sleeve as defined in claim 42, wherein the outer wall height is higher than a top surface height of the engine block.

44. A method for modifying an engine block to generate a higher performing internal combustion engine, the method comprising:

boring out cylinder bores of the engine block, thereby providing bores of increased diameter; and inserting sleeves into the increased diameter bores, wherein each sleeve comprises:

a cylindrical section having a top portion and a bottom portion, the cylindrical section configured to receive a cylinder piston that reciprocates in the block, wherein the top portion is configured to mate with a cylinder head; and a flange section adjacent to the top portion of the cylindrical section, the flange section configured with a coolant groove and at least one coolant passageway that provides an opening for coolant to pass directly into the coolant groove of the flange section and directly into the cylinder head.

45. A method as defined in claim 44, wherein the engine block is a closed-deck block.

* * * * *

UNITED STATES PATENT AND TRADEMARK OFFICE

CERTIFICATE OF CORRECTION

PATENT NO. : 6,799,541 B1
DATED : October 5, 2004
INVENTOR(S) : Clinton et al.

It is certified that error appears in the above-identified patent and that said Letters Patent is hereby corrected as shown below:

Column 14,
Line 10, please delete Claims 3, 4, 5, and 6 and insert the following:

--3. A cylinder sleeve for an internal combustion engine having an engine block and a cylinder head, the cylinder sleeve comprising:

a cylindrical section having a top portion and a bottom portion, the cylindrical section configured to receive a cylinder piston that reciprocates in the block, wherein the top portion is configured to mate with the cylinder head; and a flange section adjacent to the top portion of the cylindrical section, the flange section configured with a coolant groove and at least one coolant passageway that provides an opening for coolant to pass into the coolant groove of the flange section, wherein the coolant groove includes a plurality of partial grooves.

4. A cylinder sleeve as defined in claim 3, wherein the plurality of partial grooves are separated by at least one solid radial region.

5. A cylinder sleeve as defined in claim 1, wherein the cylindrical section includes a radial inner surface that is substantially uniform in diameter.

6. A cylinder sleeve as defined in claim 1, wherein the cylinder sleeve includes at least one straight section along a longitudinal axis to enable the cylinder sleeve to be coupled to at least one other cylinder sleeve.--

Signed and Sealed this

Eleventh Day of January, 2005

JON W. DUDAS
*Director of the United States Patent and Trademark Office*